US005129379A

United States Patent [19]

Kaneyasu et al.

[11] Patent Number: 5,129,379

[45] Date of Patent: Jul. 14, 1992

[54] DIAGNOSIS SYSTEM AND OPTIMUM CONTROL SYSTEM FOR INTERNAL COMBUSTION ENGINE

[75] Inventors: Masayoshi Kaneyasu, Hitachi; Nobuo Kurihara, Hitachiota; Kouji Kitano; Mitsuo Kayano, both of Hitachi, all of Japan

[73] Assignee: Hitachi, Ltd., Tokyo, Japan

[21] Appl. No.: 715,572

[22] Filed: Jun. 14, 1991

Related U.S. Application Data

[62] Division of Ser. No. 573,789, Aug. 28, 1990, Pat. No. 5,063,901.

[51] Int. Cl.[5] ..... F02D 41/22

[52] U.S. Cl. ..... 123/436; 123/679

[58] Field of Search ..... 123/419, 436, 489; 364/431.05

[56] References Cited

U.S. PATENT DOCUMENTS 4,489,690 12/1984 Burkel et al. ..... 123/436 X
4,718,015 1/1988 Grob et al. ..... 123/436 X
5,001,645 3/1991 Williams ..... 123/436 X

FOREIGN PATENT DOCUMENTS 2062290 5/1981 United Kingdom ..... 123/436

*Primary Examiner*—Tony M. Argenbright
*Attorney, Agent, or Firm*—Antonelli, Terry, Stout & Kraus

[57] ABSTRACT

The present specification discloses a diagnosis system and an optimum control unit for an internal combustion engine. The basic concept of the present invention resides in that a random retrieved signal of which auto correlation function is an impulse shape is superposed on a signal of an internal combustion engine, said superposed signal is used to measure a change of an operation state of the internal combustion engine, and an optimum direction of a control value is detected by a correlation between said measured value and retrieved signal. This method includes the steps of superposing a search signal for fine adjusting a fuel flow quantity value and an ignition timing on a fuel flow quantity signal and an ignition timing signal respectively, applying the fuel flow quantity signal and the ignition timing signal superposed with said search signal respectively to the internal combustion engine, detecting a value of a parameter showing a revolution number or an operation state of the internal combustion engine in response to the superposed signals, detecting a correlation between the detected value and the search signal, and carrying out diagnosis or control of the internal combustion engine based on the detected correlation.

17 Claims, 26 Drawing Sheets

2310

FAULT MODE TABLE

| | NL | NM | NS | PS | PM | PL |
|---|---|---|---|---|---|---|
| L | #4 | | | | | |
| M | | | #1, #5 | | #6 | |
| S | | | | | #3 | #2 |

(NORMAL IN HATCHING)

DIAGNOSIS SYSTEM AND OPTIMUM CONTROL SYSTEM FOR INTERNAL COMBUSTION ENGINE

This application is a division of application Ser. No. 573,789, filed Aug. 28, 1990, now U.S. Pat. No. 5,063,901.

BACKGROUND OF THE INVENTION

The present invention relates to optimum control techniques for fuel flow quantity and an ignition timing for an internal combustion engine, and more particularly, to a diagnosis method and a diagnosis apparatus for a control unit of an internal combustion engine which are suitable for an optimum control system, and a fuel control system utilizing the same.

Under the same operating conditions which become the basic conditions, such as a quantity of fuel, number of engine revolutions, load, fuel properties, etc., an internal combustion engine changes its operating torque when the fuel quantity or the ignition timing is fine adjusted, and there exist optimum values for the fuel quantity and the ignition timing at which the engine generates a maximum torque. Accordingly, it is clear that the fuel consumption rate of the internal combustion engine will be improved if the fuel quantity and the ignition timing are continuously varied so as to yield the maximum torque under different operating conditions.

It has hithereto been proposed that an actual internal combustion engine is controlled in accordance with a map data which has been prepared in advance to indicate the fuel supply quantity and the ignition timing at which a maximum output is generated in response to the number of engine revolutions and load on the internal combustion engine. However, the optimum fuel quantity and ignition timing fluctuate with behaviour of individual engines and due to ageing caused by carbon deposites, sensor drift, actuator drift, and in the use of fuels with different octane numbers. It has, therefore, been extremely difficult to control the engine in proper response to such fluctuating conditions.

In the mean time, an article published in the SAE PAPER (SAE) 870083 (February 1982) pp. 43–50 discloses a method for predicting an ignition timing which gives a maximum torque output from a detected rate of change of rotation of an internal combustion engine when the engine speed is changed by increasing or decreasing the ignition timing while the internal combustion engine is running. This is a method for moving the ignition timing advance angle in proportion to the gradient of the output torque of the internal combustion engine.

Thus, denoting the output torque of an internal combustion engine by T, denoting the number of engine revolutions by N, and denoting the ignition advance angle by $\theta$, then the following formula applies:

$$\frac{\Delta T}{\Delta \theta} = \frac{\Delta T}{\Delta N} \cdot \frac{\Delta N}{\Delta \theta} \approx K \frac{\Delta N}{\Delta \theta}$$

An optimum control is, therefore, achieved by applying the so-called hill-climbing method; that is to say instead of determining the change gradient of output torque to ignition advance angle ($\Delta T/\Delta\theta$), a change gradient of the number of revolutions of the internal combustion engine to ignition advance angle ($\Delta N/\Delta\theta$) is determined, and the amount of the ignition advance angle is moved in proportion to the gradient of the characteristic $\Delta N/\Delta\theta$.

The above method, however, has a problem in its signal-to-noise ratio. By nature, an internal combustion engine has subtle revolutional variations attributable to various factors. These variations in the revolutions become noise components due to changes of the engine revolutions in response to increase or decrease of an ignition timing. In order to obtain sufficient detection sensitivity of a changing signal which can be discriminated from the noise components, it is necessary to take a large width for the increase and decrease of the ignition timing so as to take a sufficiently large quantity of variations of the revolutions of the internal combustion engine. These large variations of revolutions give a large schock to car drivers who are expecting normal smooth driving conditions, and are never desirable because of aggravated driving comfort and drivability.

It is an object of the present invention to provide a new method for obtaining an optimum control value of a control system for an internal combustion engine by providing a minimum change in its operating state within a range in which a normal operation of the internal combustion engine is not interrupted, and also to provide a diagnosis method for an internal combustion engine utilizing the above method, an optimum control method for a fuel flow quantity and an ignition timing, and a control apparatus which can utilize these methods.

SUMMARY OF THE INVENTION

The basic concept of the present invention is to measure a change of an operating state of an internal combustion engine with a signal of the internal combustion engine which is superposed with a random detection signal having an impulse type self-correlation function, and to detect an optimum direction of a control value based on a correlation between the measured value and the detection signal. This method includes the steps of: superposing a fuel flow quantity signal and an ignition timing signal respectively with a search signal having a fine variation of a fuel flow quantity value and an ignition timing; supplying the fuel flow quantity signal and the ignition timing signal superposed with the search signal respectively, to the internal combustion engine; detecting a value of a parameter which shows a number of revolutions or an operation state of the internal combustion engine in response to the superposed signals; detecting a correlation between the detected value and the search signal; and carrying out a diagnosis or a control of the internal combustion engine based on the detected correlation.

DESCRIPTION OF THE PREFERRED EMBODIMENTS

Embodiments of the present invention will be explained below with reference to FIG. 1 to FIG. 18.

Figure 1:
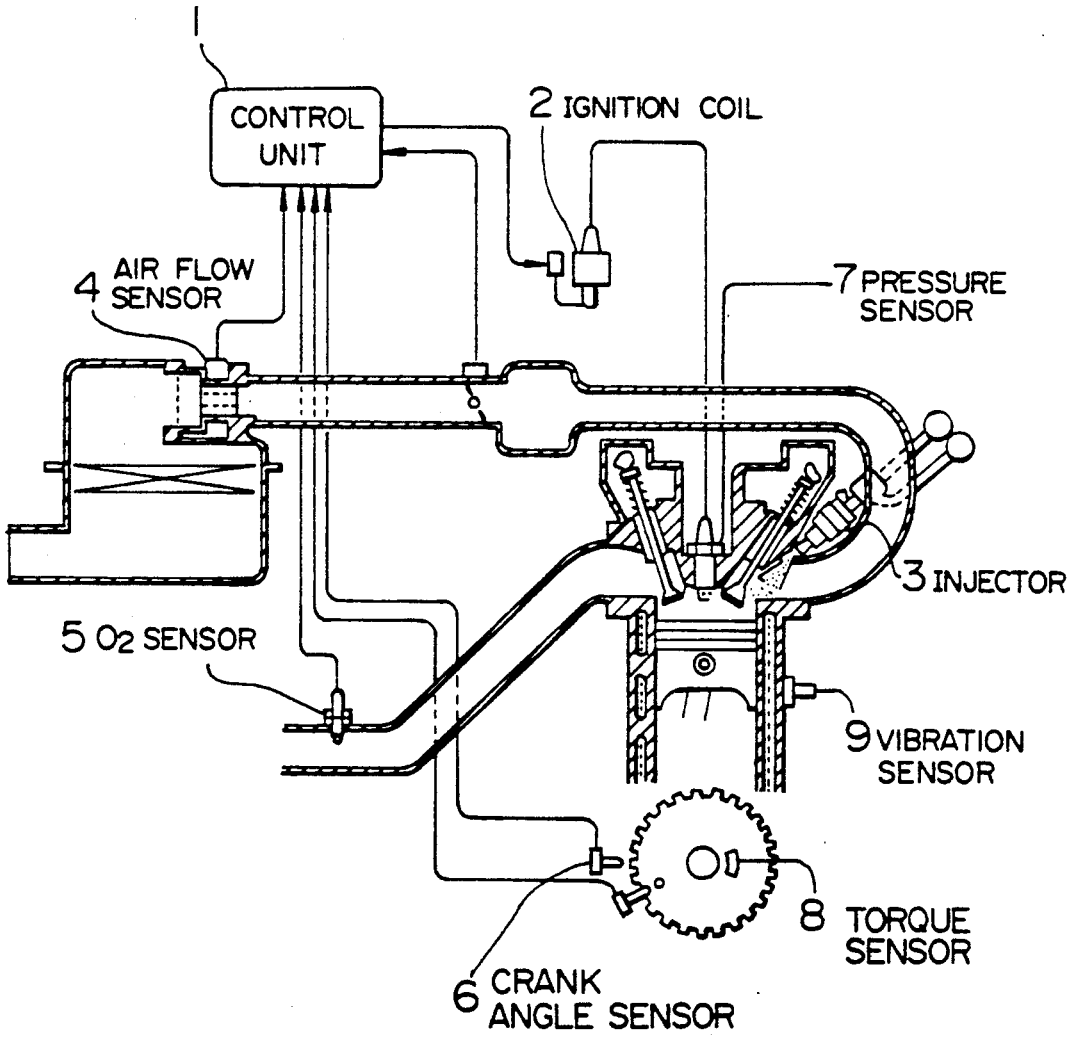
FIG. 1 is a diagram of a control system of an internal combustion engine to which the present invention is applied.

FIG. 1 is a configuration diagram showing the control system for a gasoline engine to which the present invention is applied. A control unit 1 having a microcomputer drives an ignition coil 2 and an injector 3, and an operation state of the engine is measured by an air flow sensor 4, an $O_2$ sensor 5, a crank angle sensor 6, a cylinder pressure sensor 7, a torque sensor 8, a vibration sensor 9, etc., so that the operation state of the engine is controlled in the optimum condition.

Figure 2:
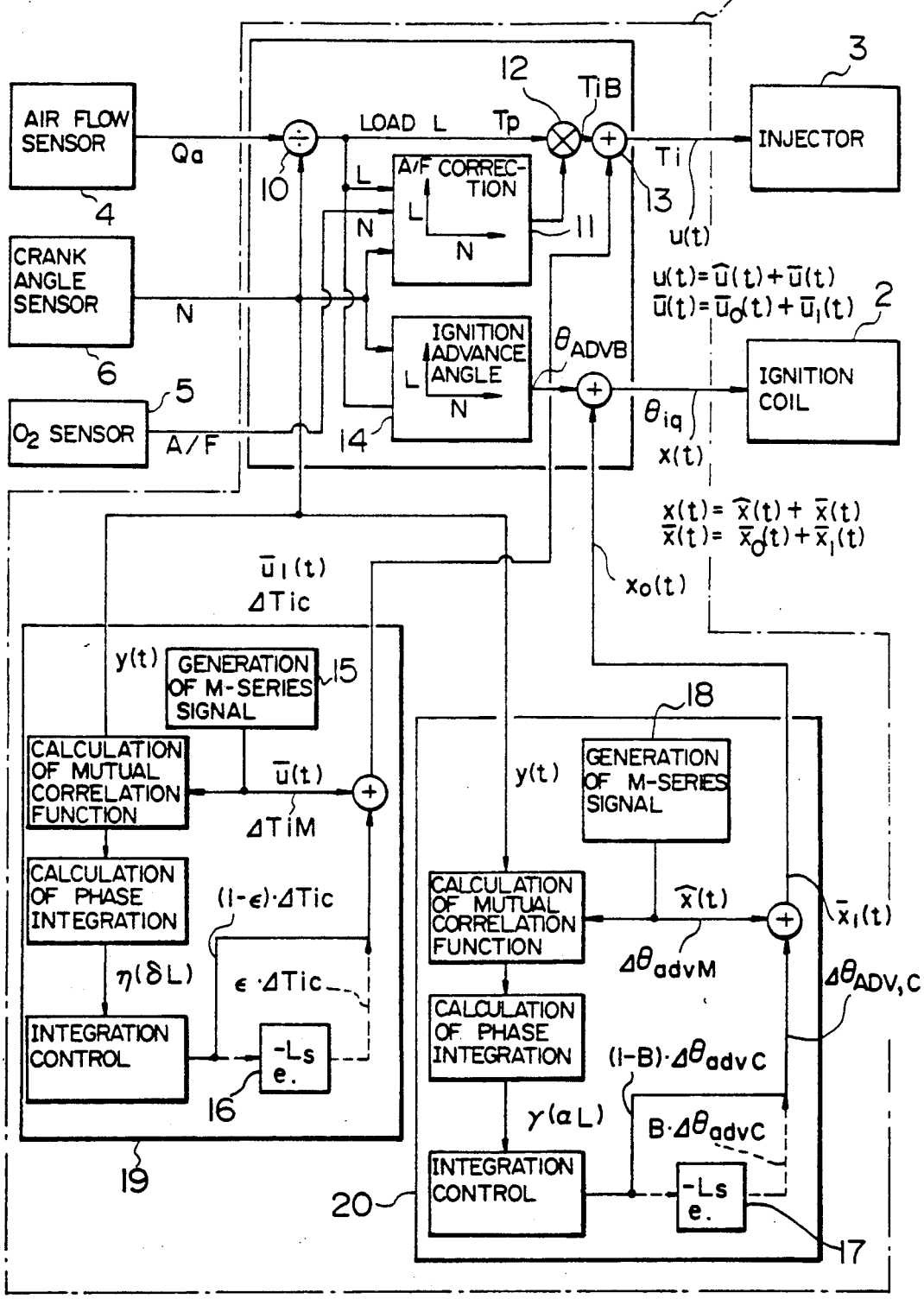
FIG. 2 is a block diagram showing an embodiment of an optimum control system according to the present invention.

FIG. 2 is a block diagram showing one embodiment of the optimum control system for a fuel flow quantity and an ignition timing, according to the present invention. A number of revolutions N of the internal combustion engine is detected by a crank angle sensor 6, and a quantity of air Qa taken in by the internal combustion engine is detected by an air flow sensor 4. An M series signal which is a pseudo-random signal is used as a search signal. This signal is superposed on each of the fuel injection time signal and the ignition timing signal, and a correction signal is generated from a phase integration value of a correlation function between the M series signal and the number of revolutions N, so that the fuel injection time and the ignition timing are optimized.

Figure 10A:
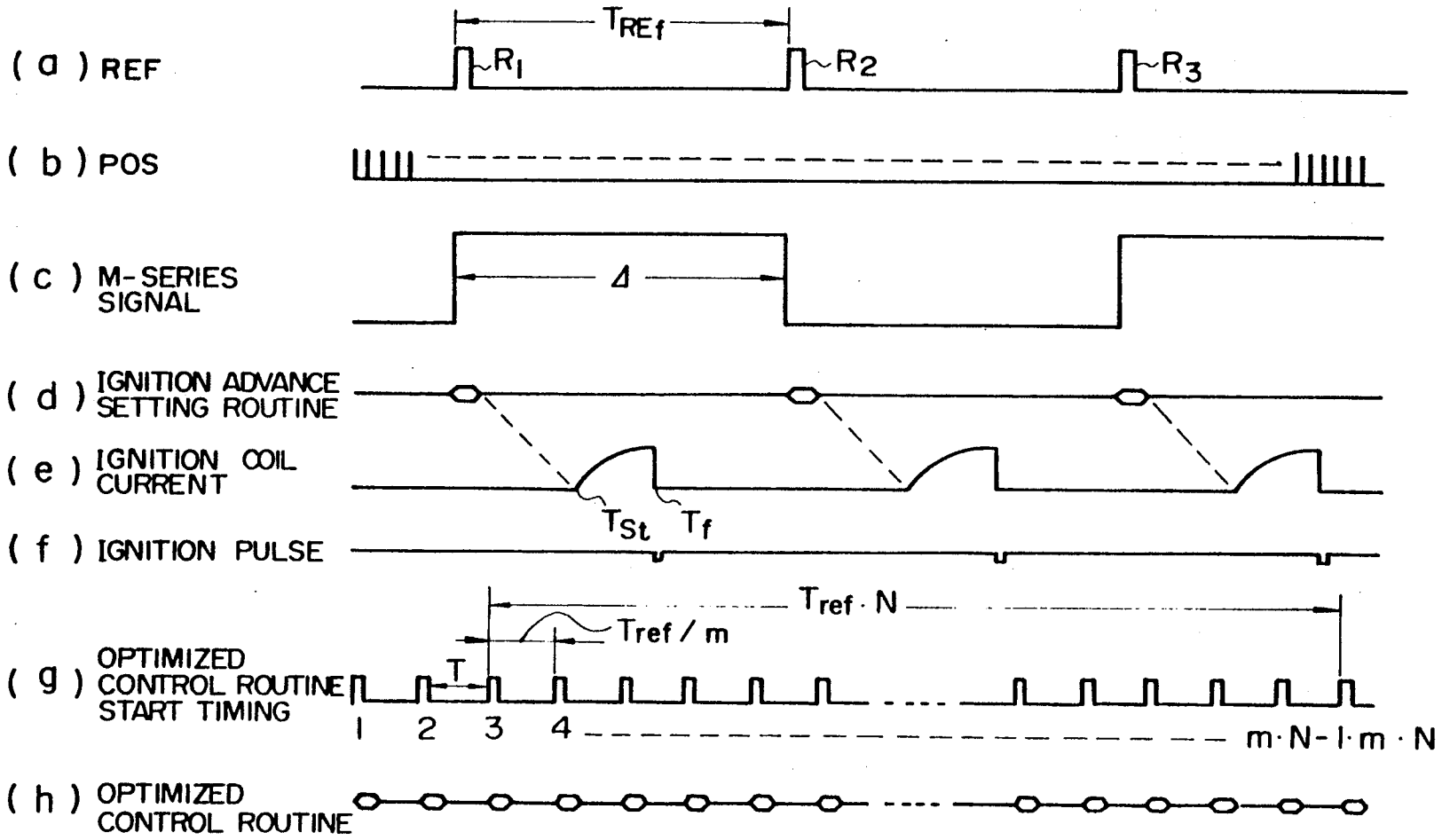
FIGS. 10A(*a–h*) and 10B(*a–g*) are signal timing charts in the optimum control system.
Figure 10B:
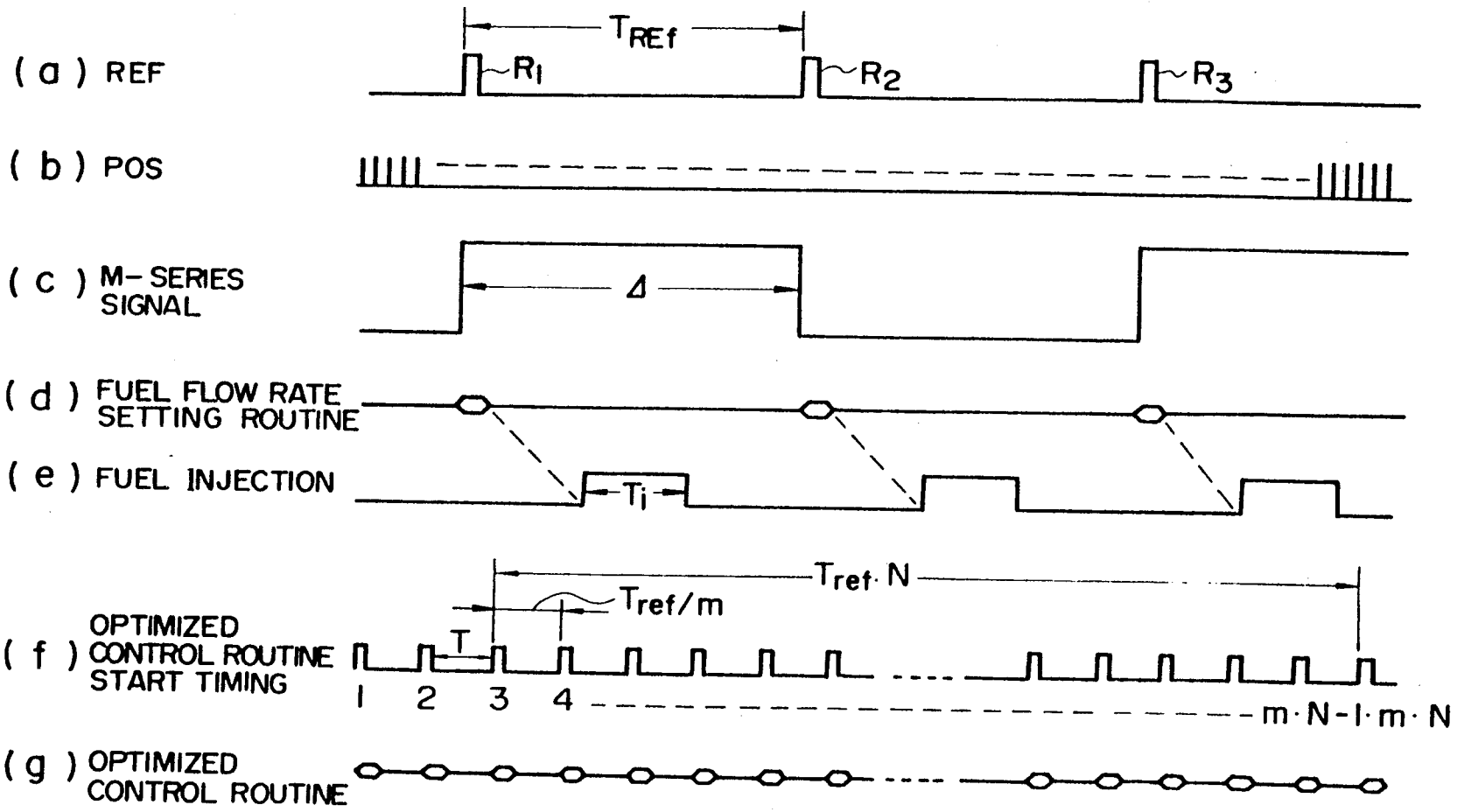

The crank angle sensor 6 supplies a reference signal REF generated at an angle 110° before a TDC (top dead center) of each cylinder and a position signal POS generating a pulse each time when the engine makes a revolution of 1°, to the control unit 1, as shown in (a) and (b) of FIGS. 10A and 10B, for example. A divider 10 calculates a ratio of the air quantity Qa to the number of revolutions N of the internal combustion engine Qa/N=L (corresponding to a value of the load), and generates a basic injection time signal $T_P$ in accordance with the load L. An air-fuel ratio correction portion 11 calculates an air-fuel ratio correction signal or a correction parameter in accordance with the load L, the number of revolutions N of an internal combustion engine and an output A/F of the $O_2$ sensor. The arithmetic portion 10 adds a corrected injection time calculated by the air-fuel ratio correction portion 11 to the basic injection time $T_P$ determined in accordance with the load L, or multiplies a correction parameter to the basic time to produce an output of an actual fuel injection time TiB.

Figure 3A:
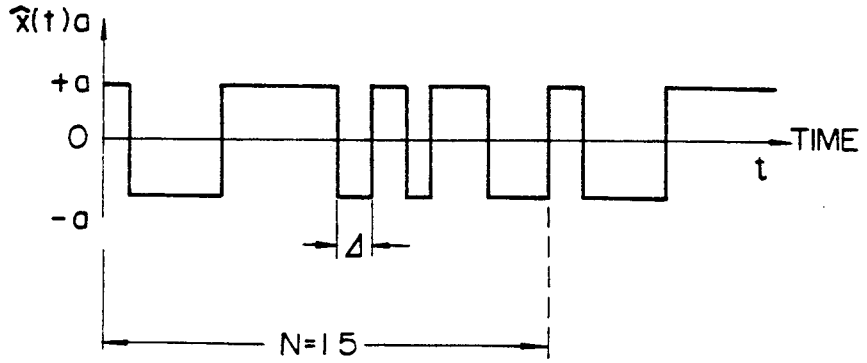
FIGS. 3A and 3B are waveform diagrams of an M series signal used in the embodiment of the present invention.
Figure 3B:
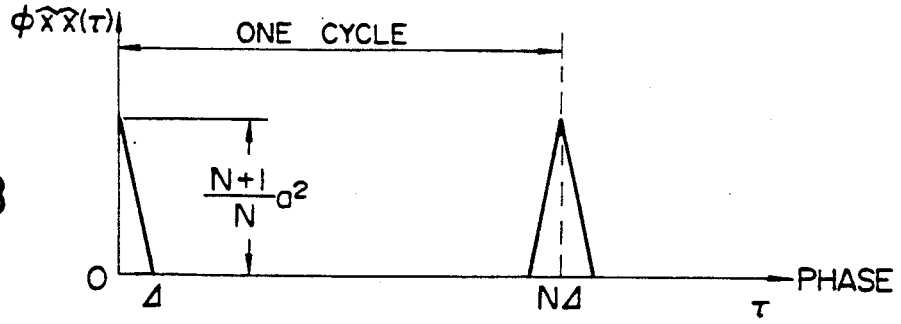
Figure 5A:
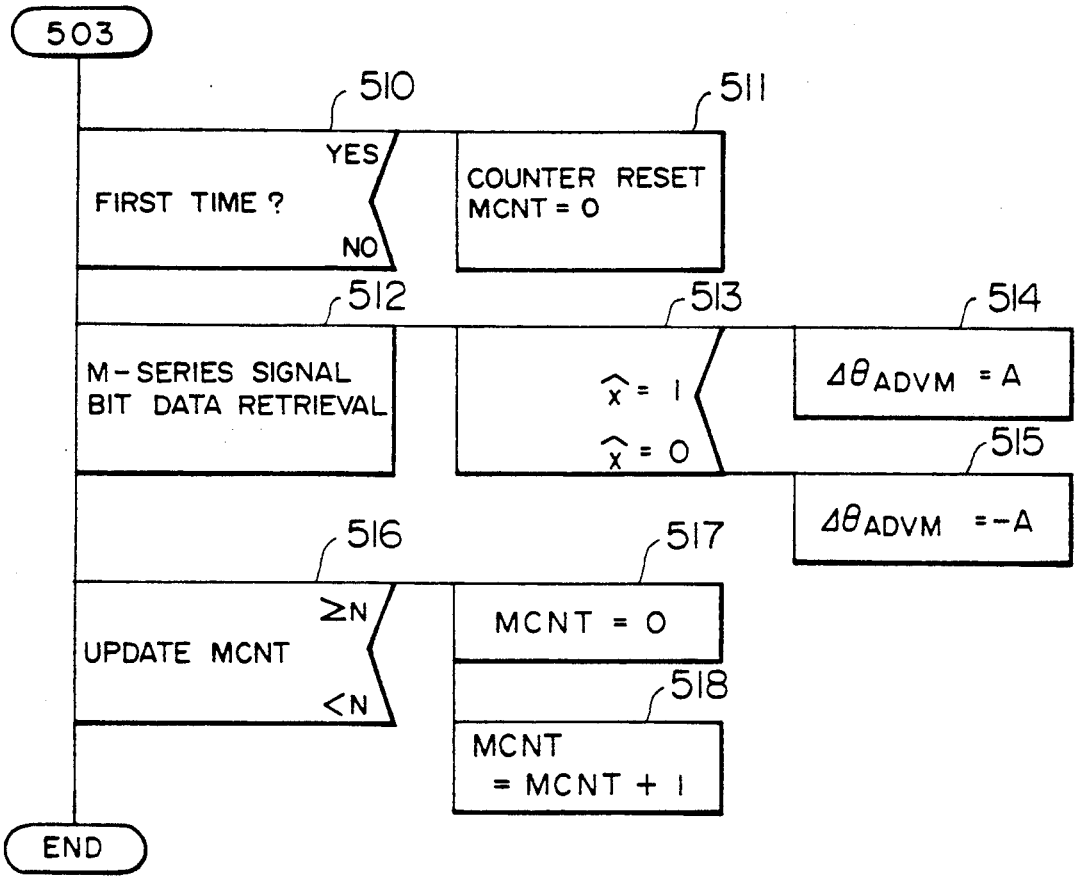
Figure 5B:
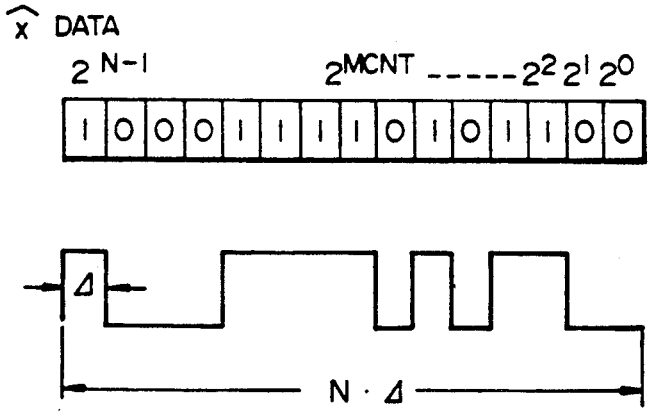

The M series signal which is a retrieval signal is produced as an M series signal component fuel injection time ΔTiM by an M series signal generation portion 15 based on the data stored in advance, as shown in FIG. 5B, and is then superposed on the basic fuel injection time ΔTiB. After the fuel injection time is changed by the M series signal, the number of revolutions N of the internal combustion engine is detected and a correlation function between the M series signal and the number of revolutions N and a shift phase integration thereof are sequentially obtained. An optimized fuel injection time in accordance with the shift phase integration value ΔTiC is superposed on the basic fuel injection time ΔTiB, and the fuel injection time Ti is applied to the injector 18. The injector 18 injects fuel to a cylinder of the internal combustion engine during the injection time Ti. As shown in FIG. 3A, the M series signal has parameters of an amplitude a and a minimum pulse width Δ, a cycle NΔ (N: a maximum sequence. 7 and 31 can also be used instead of 15 used in the embodiment), and the autocorrelation function is substantially an impulse-state as shown in FIG. 3B. During the above optimum control of fuel, the air-to-fuel ratio feedback control by the $O_2$ sensor 5 may be cancelled.

On the other hand, an ignition timing determination portion 14 generates a basic ignition advance angle ΔadvB which is determined in accordance with the number of revolutions N of the internal combustion engine and the load L. The M series signal relating to the ignition timing is generated as an M series signal component ignition advance angle Δθadv M from an M series signal generator 18, and is superposed on the basic ignition advance angle θadvB. After the ignition timing has been altered by the M series signal, the number of revolutions N of the internal combustion engine is detected and a correlation function between the M series signal and the number of revolutions N and the shift phase integration thereof are sequentially obtained. An optimized ignition advance angle ΔθadvC in accordance with the shift phase integration value is superposed on the basic ignition advance angle θadvB, and an ignition timing θig is given to the ignition coil.

As described later, an M series signal û(t) is generated in an amplitude a of a range which provides a change of the number of revolutions that cannot be felt by the driver. This signal is superposed on the fuel injection time Ti. A mutual correlation function between the M series signal û(t) and the number of revolutions y of the internal combustion engine in this case and the shift phase integration are calculated to obtain an output torque gradient η(δL). The output torque gradient $\eta(\delta L)$ is integrated and is superposed on the initial fuel injection time in order to determine an increase and a decrease of the fuel injection time from the current value in accordance with plus or minus and size of the output torque gradient $\eta(\delta L)$.

Superposition of the integration value of the output torque gradient of the M series signal is repeated in the similar manner so that the fuel injection time is controlled to the always at an optimum value.

The M series signal makes a subtle change and the integration value of the output torque gradient changes smoothly. Therefore, as shown within the dotted line of FIG. 2, even if this signal is directly superposed as an optimized fuel injection time ΔTiC together with the M series signal component fuel injection time ΔTiM on the basic ignition advance angle ΔTiB, there is small variation in the number of revolutions of the internal combustion engine and drivability is not lost either.

When the loss of drivability is anticipated because of a large value of the optimized fuel injection time ΔTiC obtained as a result of application of the M series signal for a predetermined period, delay circuits 16 and 17 as shown within the dotted line of FIG. 2 are used to divide the optimized control component into two stages so that a sudden variation of the number of engine revolutions can be avoided. Detailed method for this will be explained later. A fuel injection time optimized M series signal processing 12, an ignition timing optimized M series signal processing 16, an ignition timing control unit 14 and an air-fuel-ratio correction unit 8, are all executed by a microcomputer.

An embodiment for optimizing the ignition timing by using the M series signal as a search signal will be explained in detail with reference to equations.

The impulse response $g(\alpha)$, when an M series signal $\hat{x}(t)$ is used as the input signal of the process (engine control system) is determined by calculating the mutual correlation function $\phi\hat{x}y(\alpha)$ of the input $\hat{x}(t)$ and the output y(t) based on the input signal $\hat{x}(t)$. Accordingly, if the following relation holds in FIG. 2, $$\bar{x}(t)=\bar{x}_0(t)+\bar{x}_1(t)$$

the equations (1) and (2) below hold. Because $\bar{x}(t)$ changes more slowly than $\hat{x}(t)$, it can be regarded as a DC component. $\bar{y}(t)$ is an output of the DC component of this input signal.

$$x(t)=\hat{x}(t)+\hat{x}(t) \tag{1}$$

$$y(t)=\bar{y}(t)+\hat{y}(t) \tag{2}$$

If the amplitude of search signal $\hat{x}(t)$ which is the input signal is sufficiently small, the combustion efficiency characteristics (which are the output torque characteristics in relation to the fuel quantity and ignition timing) of the internal combustion engine within this amplitude can be regarded as linear. Accordingly, the relation between the search signal $\hat{x}(t)$ and the output component $\hat{y}(t)$ corresponding to this $\hat{x}(t)$, that is, the relation between the ignition timing and the number of revolution of the internal combustion engine, can be expressed by the following equation (3) to (5) by using the impulse response $g(\alpha)$.

$$y(t) = \int_o^{N\Delta} g(\tau)\{\bar{x}(t) + \hat{x}(t-\tau)\}d\tau \tag{3}$$

-continued $$y(t) = \int_o^{N\Delta} g(\tau)\bar{x}(t)d\tau \tag{4}$$

$$y(t) = \int_o^{N\Delta} g(\tau)\hat{x}(t-\tau)d\tau \tag{5}$$

NΔ: one cycle of the M series signal

Δ: minimum pulse width of the M series signal

N: sequence number of the M series signal

Further, the mutual correlation function $\phi\hat{x}\hat{y}(\alpha)$ for the search signal $\hat{x}(t)$ and the output signal $\hat{y}(t)$ is represented by the following equation (6).

$$\phi xy(\alpha) = \int_o^{N\Delta} g(\tau)\phi\hat{x}\hat{x}(\alpha-\tau)d\tau \tag{6}$$

Here, $\phi\hat{x}\hat{x}(\alpha)$ is an autocorrelation function for the M series signals, and is given by the following formula:

$$\phi\hat{x}\hat{x}(\alpha) = \int_o^{N\Delta} \hat{x}(t)\hat{x}(\alpha-t)d\tau \tag{7}$$

Because, the search signal $\bar{x}(t)$ is an M series signal which includes all frequency components, its power spectrum density function $\phi\hat{x}\hat{x}(\omega)$ is constant, accordingly.

$$\phi\hat{x}\hat{x}(\omega)=\phi xx(o)$$

As a result, the autocorrelation function, $\phi\hat{x}\hat{x}(\alpha-\tau)$, which appears in the equation (6), is represented by an equation (8) using a delta function δ;

$$\phi\hat{x}\hat{x}(\alpha-\tau)=\phi\hat{x}\hat{x}(o)\cdot\delta(\alpha-\tau) \tag{8}$$

Hence, the mutual correlation function $\phi\hat{x}y(\alpha)$ shown in the equation (6) is transformed as follows;

$$\begin{aligned}\phi\hat{x}\hat{y}(\alpha) &= \int_o^{N\Delta} g(\tau)\cdot\phi\hat{x}\hat{x}(o)\cdot\delta(\alpha-\tau)d\tau \\ &= \phi\hat{x}\hat{x}(o)\int_o^{N\Delta} g(\tau)\cdot\delta(\alpha-\tau)d\tau \\ &= \phi\hat{x}\hat{x}(o)\lim_{\epsilon\to o}\int_{\alpha-\epsilon}^{\alpha+\epsilon} g(\tau)\cdot\delta(\alpha-\tau)d\tau \\ &= \phi\hat{x}\hat{x}(o)\cdot g(\alpha)\end{aligned} \tag{9}$$

As is evident from the above, the impulse response $g(\alpha)$ is given by an equation ((o) below using the mutual correlation function $\phi\hat{x}\hat{y}(\alpha)$ between $\hat{x}(t)$ and $\hat{y}(t)$.

$$g(\alpha)=\phi\hat{x}\hat{y}(\alpha)/\phi\hat{x}\hat{x}(o) \tag{10}$$

where, $\phi\hat{x}\hat{x}(o)$ corresponds to the integrated value of the autocorrelation function $\phi\hat{x}\hat{x}$, and is given by the following equation;

$$\phi\hat{x}\hat{x}(o)=(N+1)\Delta\cdot a^2/N=Z\ \text{(constant)} \tag{11}$$

where a: amplitude of the M series signal.

The mutual correlation function $\phi\hat{x}\hat{y}(\alpha)$ is transformed as shown below using an equation (2);

$$\begin{aligned}\phi\hat{x}y(\alpha) &= \int_{o}^{N\Delta} y(t)\cdot\hat{x}(\alpha-t)dt \\ &= \int_{o}^{N\Delta}\{y(t)-\bar{y}(t)\}\cdot\hat{x}(\alpha-t)dt \\ &= \int_{o}^{N\Delta}\{y(t)\hat{x}(\alpha-t)dt-\int_{o}^{N\Delta}\bar{y}(t)\cdot\hat{x}(\alpha-t)dt \\ &= \phi\hat{x}y(\alpha)-\phi\hat{x}\bar{y}(\alpha)\end{aligned} \tag{12}$$

Thus, $$g(\alpha)=\{\phi\hat{x}y(\alpha)-\phi\hat{x}\bar{y}(\alpha)\}/Z \tag{13}$$

where the second term of the equation (13) $\phi x\bar{y}(\alpha)$ is the mutual correlation function between the M series signal x(t) and the DC component of the output $\bar{y}(t)$. The first term $\phi xy(\alpha)$ is a mutual correlation function between the M series signal input $\hat{x}(t)$ and the output y(t). y(t) is composed of fluctuating components due to the influence of the M series signal $\hat{x}(t)$, and the DC component from x(t); however, it is difficult to separate and detect these components, so that a directly obtainable function is a mutual correlation function $\phi\hat{x}y$ shown by the following equation.

$$\phi xy = \int_{o}^{N\Delta} y(t)\cdot x(\alpha-t)d\tau \tag{13'}$$

The value of $\phi\hat{x}\bar{y}(\alpha)$ agrees with the value of $\phi\hat{x}y(\alpha)$ if the value of $\alpha$ is taken large until it is no longer influenced by $\hat{x}(t)$. Therefore, $\phi\hat{x}\bar{y}(\alpha)$ can be approximated to the average value of $g(\alpha)$ in the interval between $\alpha_1$ and $\alpha_2$ of $\phi\hat{x}y(\alpha)$.

$$g(\alpha)\approx\left\{\phi\hat{x}y(\alpha)-\frac{1}{\alpha_2-\alpha_1}\int_{\alpha_1}^{\alpha_2}\phi\hat{x}y(\alpha)d\alpha\right\}/Z \tag{14}$$

where, $\alpha_1$ and $\alpha_2$ are bias correction terms and they are selected to have values close to $N\cdot\Delta$.

The indicial reponse $\gamma(\alpha_L)$ in the interval between $\alpha_S-\alpha_L$ is given by an equation (15).

$$\gamma(\alpha L)=\int_{\alpha_S}^{\alpha_L} g(\alpha)d\alpha \tag{15}$$

$\alpha_S$ is the starting time of the integration in consideration of the leading edge of the impulse response due to the pseudo-white noise of the M series signal. $\alpha_L$ is the ending time of the integration interval for impulse response integration. This is set in advance, in accordance with the impulse response characteristics. This indicial response $\gamma(\alpha L)$ corresponds to the change in number of revolutions of the internal combustion engine, when the ignition timing is changed by a unit quantity by the search signal, and this is called the output torque gradient.

In the embodiment of the present invention shown in FIG. 2, the optimum ignition timing is more smoothly achieved by superposing the further integration of the above-mentioned output torque gradient $\gamma(\alpha L)$ on the ignition timing signal $\theta$ig.

The invention will now be described by way of an embodiment using a microcomputer.

Figure 4A:
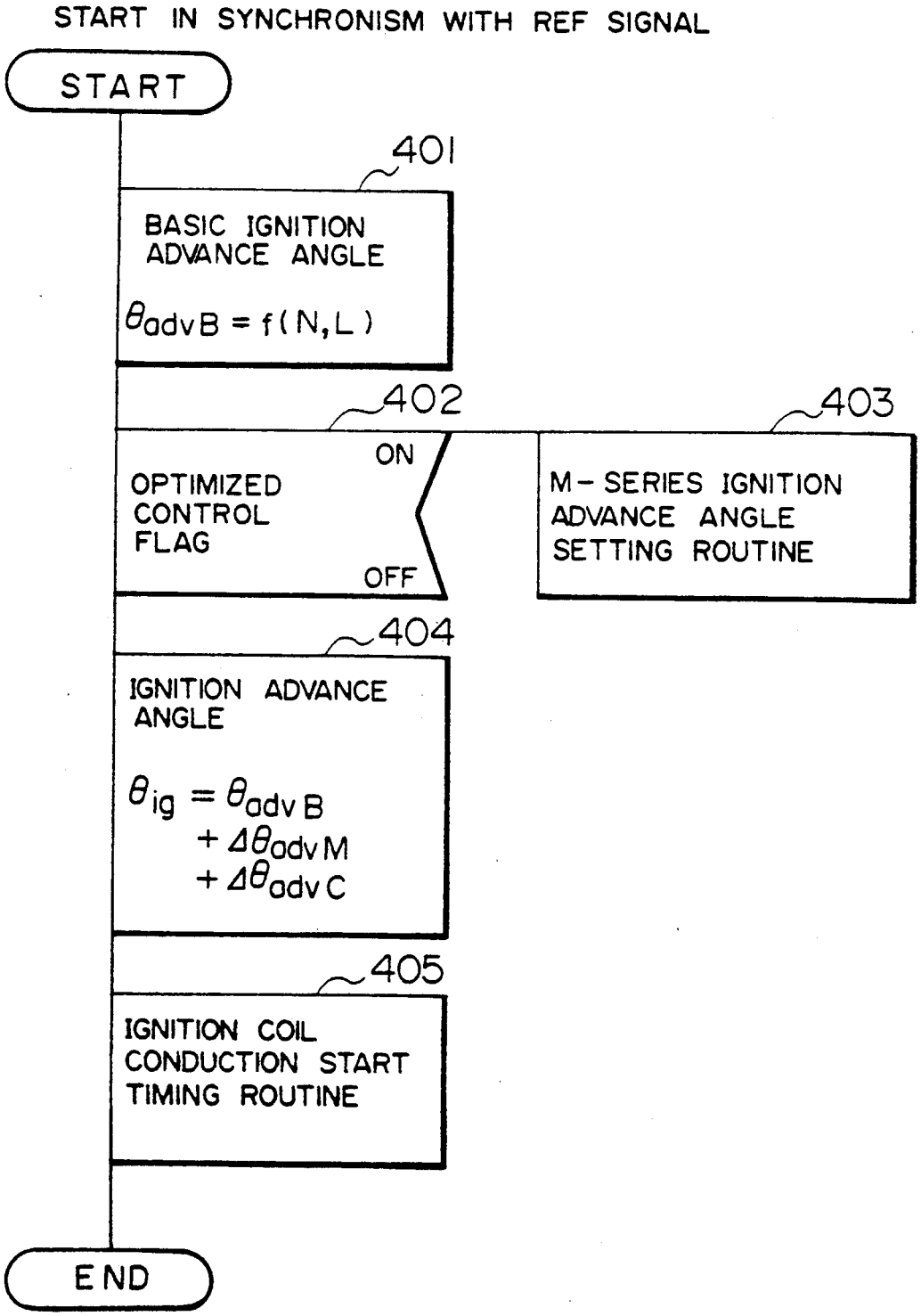
FIGS. 4A, 4B, 5A, 5B, 6, 7A, 7B, 8A and 8B are flow charts applied when the optimum control system of the present invention is implemented by using a computer.

FIG. 4A is a diagram for explaining the processing flow for executing the embodiment of optimizing the ignition timing shown in FIG. 2 by utilizing a microcomputer. In a basic ignition advance angle routine 401, a basic ignition advance angle $\theta$advB, which has been set in advance based on the revolution number N of the internal combustion engine and the load L, is determined. Next, in an optimized control routine 402 under the flag ON condition an M series ignition advance angle setting routine 403 is set to start. In an ignition advance angle routine 404, the ignition advance angle $\theta$ig determined using an equation (16).

$$\theta ig=\theta advB+\Delta\theta advM+\theta advC \tag{16}$$

where, $\theta$ig: ignition advance angle, $\theta$advB: basic ignition advance angle, $\theta$advM: M series signal component of the ignition advance angle, $\theta$advC: optimized signal component of the ignition advance angle.

In an ignition energizing start timing routine 405, the power is supplied to the ignition coil.

Figure 4B:
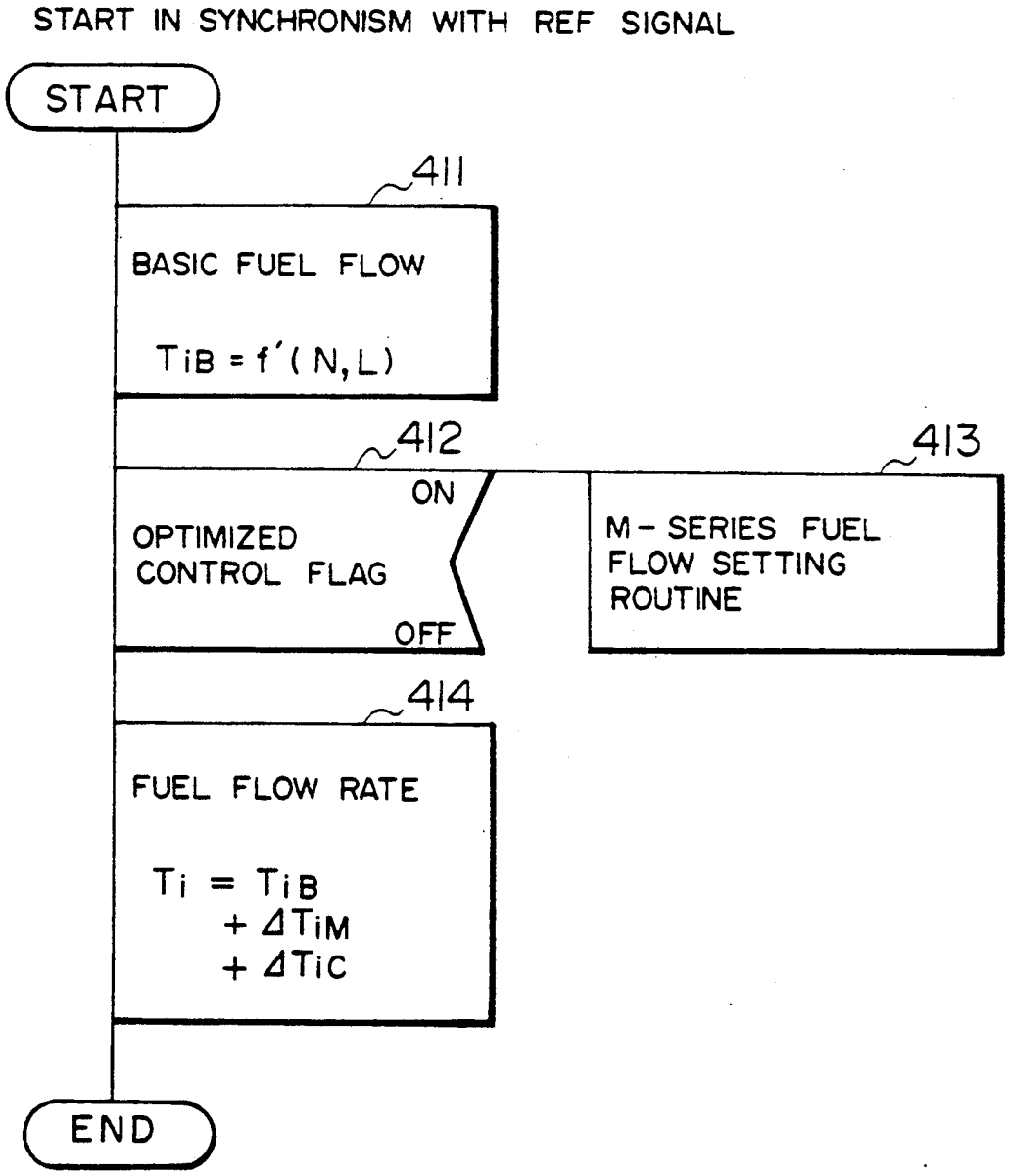

FIG. 4B is a flow chart for the case where the control for optimizing the fuel injection time based on the M series signal shown in FIG. 2 is executed by using a microcomputer. In a basic fuel injection time routine 411, a basic fuel injection time TiB, which has been set in advance based on the revolution number N of the internal combustion engine and the load L, is determined. Next, in an optimized control routine 412 under the flag ON condition an M series ignition advance angle setting routine 413 is set to start. Further, in a fuel injection time routine 414, a fuel injection time Ti is determined using an equation (16').

$$Ti=TiB+\Delta TiM+\Delta TiC \tag{16'}$$

where,

Ti: fuel injection time,

TiB: basic fuel injection time, $\Delta$TiM: M series signal component fuel injection time, $\Delta$TiC: optimized signal component fuel injection time.

FIG. 5A is a diagram which shows in detail the M series signal component ignition advance angle set routine 403 shown in FIG. 4. On this routine, the M series signal are generated by successive readout of bit data from previously set M series signal (t) data. At first, a counter MCNT is set to zero. Retrievals of the M series signal bit data are then performed. An M series signal component ignition advance angle $\Delta\theta$advM is generated using an equation (17).

$$\left.\begin{aligned}&\text{when } x(t)=1,\ \Delta\theta advM=A\\ &\text{when } x(t)=0,\ \Delta\theta advM=A\end{aligned}\right\} \tag{17}$$

Next the above is updated in accordance with a counter MCNT (17') equation.

$$\left.\begin{array}{l}\text{when } MCNT \geqq N,\ MCNT = 0 \\ \text{when } MCNT < N,\ MCNT = MCNT + 1\end{array}\right\} \quad (17')$$

where, N: number of sequence of the M series signal.

Figure 6:
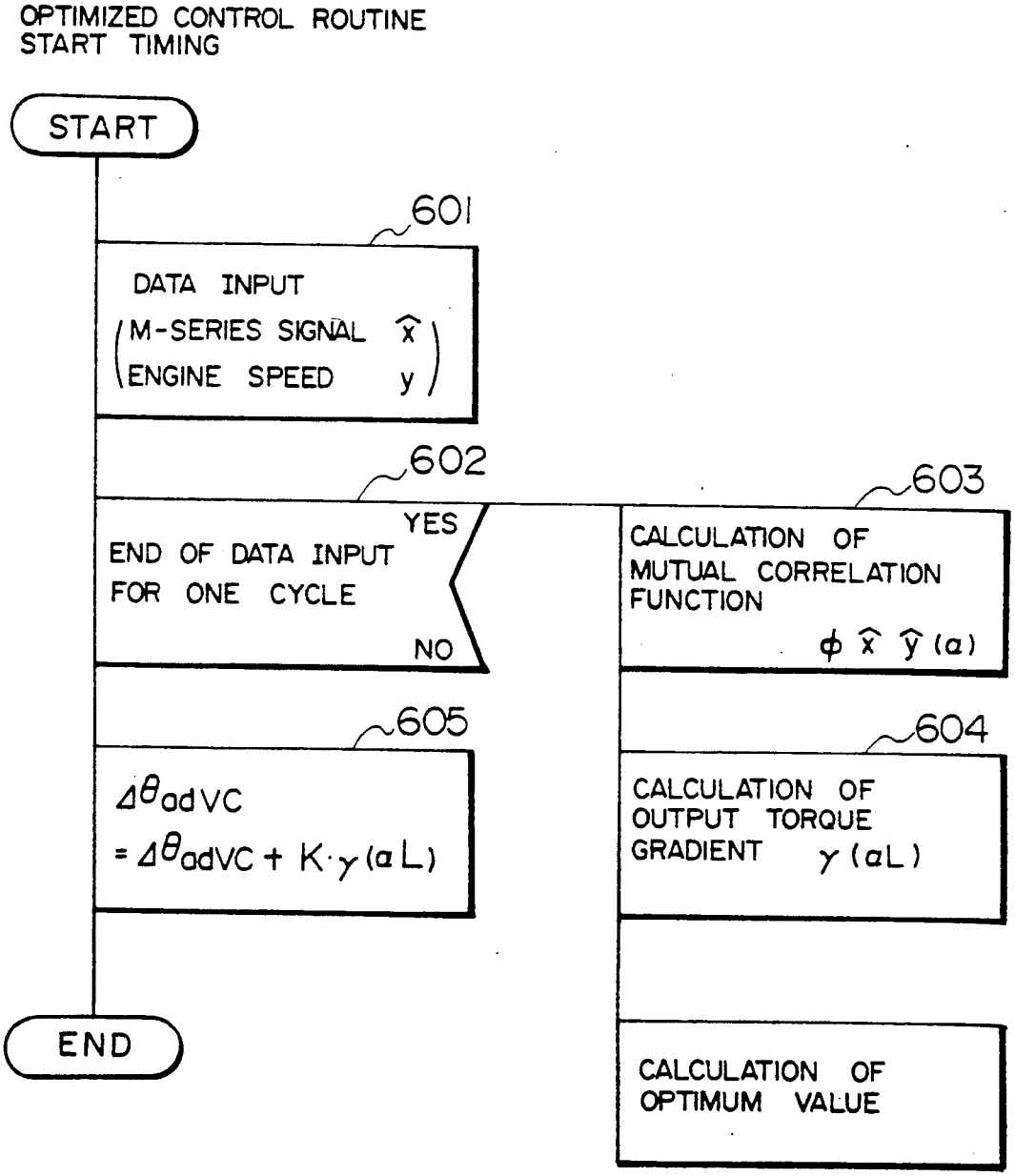
Figure 7A:
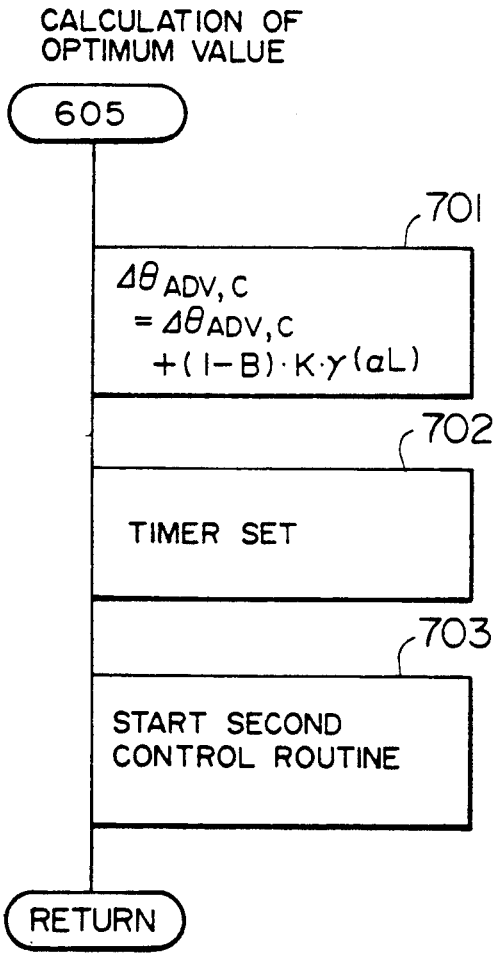
Figure 7B:
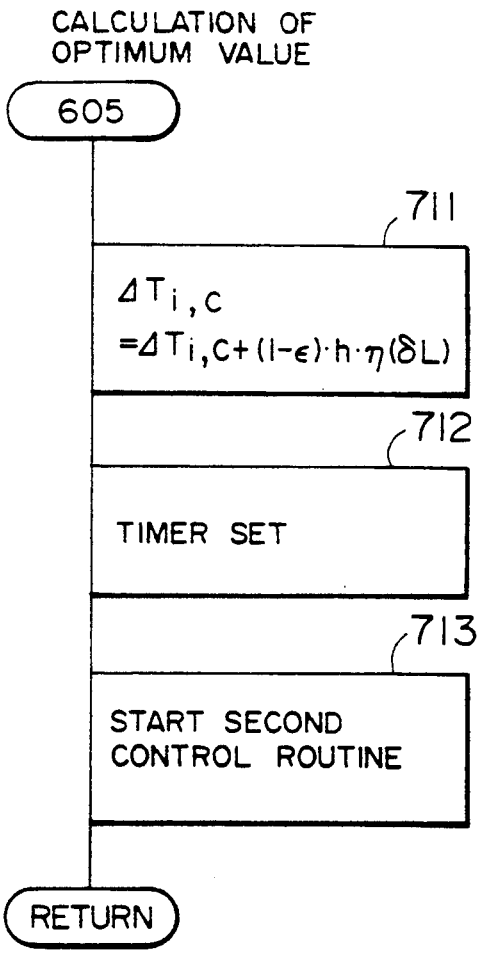

FIG. 6 shows an optimized control routine. First, an M series signal $\hat{x}(t)$ and a revolution number y of the internal combustion engine are synchronously sampled with a data input 601, and the result is inputted to a microcomputer and stored in it. When one cycle of the M series signal has been sampled, a mutual correlation function $\phi\hat{x}\hat{y}(\alpha)$ is calculated in accordance with equations (12) and (13'), and then an output torque gradient $\gamma(\alpha L)$ is calculated in accordance with equations (14) and (15), where m is an integer as described later. Next, an optimized signal component of the ignition timing and the fuel injection time is obtained in accordance with equations (18) and (19) as shown in FIGS. 7A and 7B.

$$\Delta\theta advC = \Delta\theta advC + (1-\beta)k\cdot\gamma(\alpha L) \quad (18)$$

$$\Delta TiC = \Delta TiC + (1-\epsilon)h\cdot\eta(\delta L) \quad (19)$$

where, k, h: integration control gains which are parameters showing the relation between the output torque gradient and the optimum ignition timing, being set depending on the internal combustion engine, $\beta$, $\epsilon$: shows ratios for outputting by delaying the phase, being set to 0.5 to 0.7.

Figure 8A:
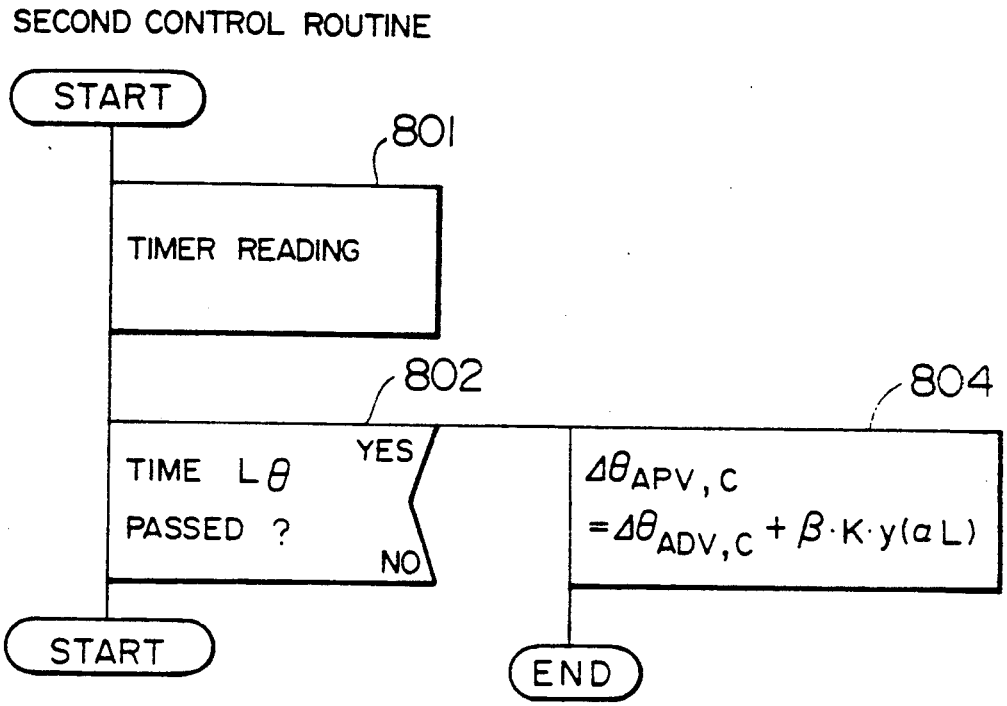
Figure 8B:
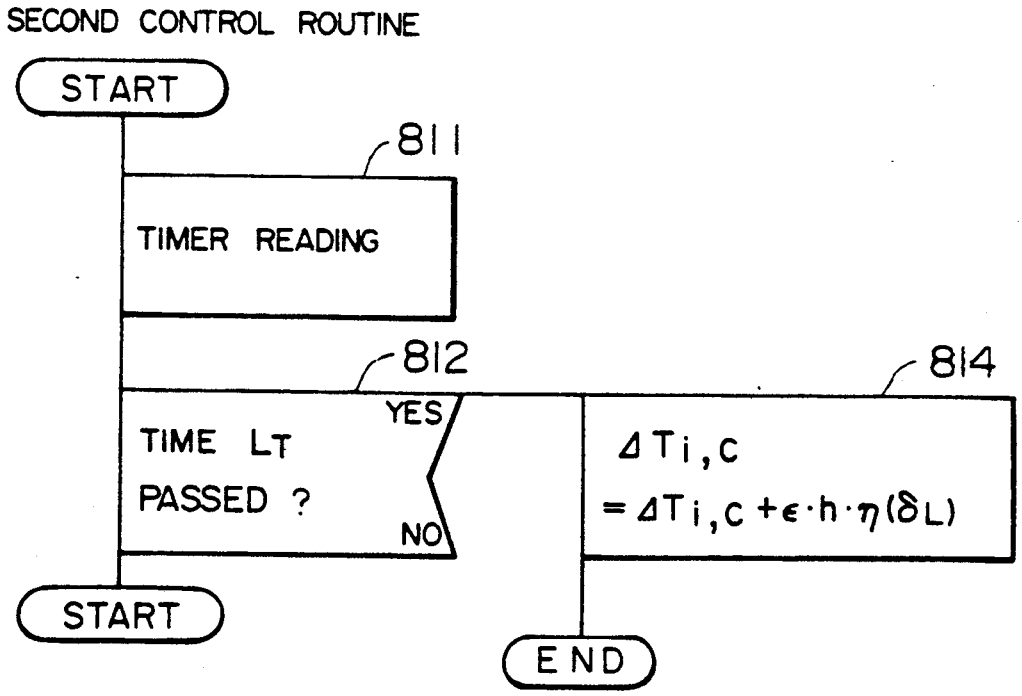

In order to produce an output by further delaying the phase, a second control routine which is an independent processing routine provided by setting a timer as shown in FIGS. 7A and 7B, is started. As shown in FIG. 8, in the second control routine, a timer is read and equations (18') and (19') are executed if the phase is delayed by $L_{74}$ or $L_T$.

$$\Delta\theta advC = \Delta\theta advC + \beta\cdot k\cdot\gamma(\alpha L) \quad (18')$$

$$\Delta TiC = \Delta TiC + \epsilon\cdot h\cdot\eta(\delta L) \quad (19')$$

Figure 9:
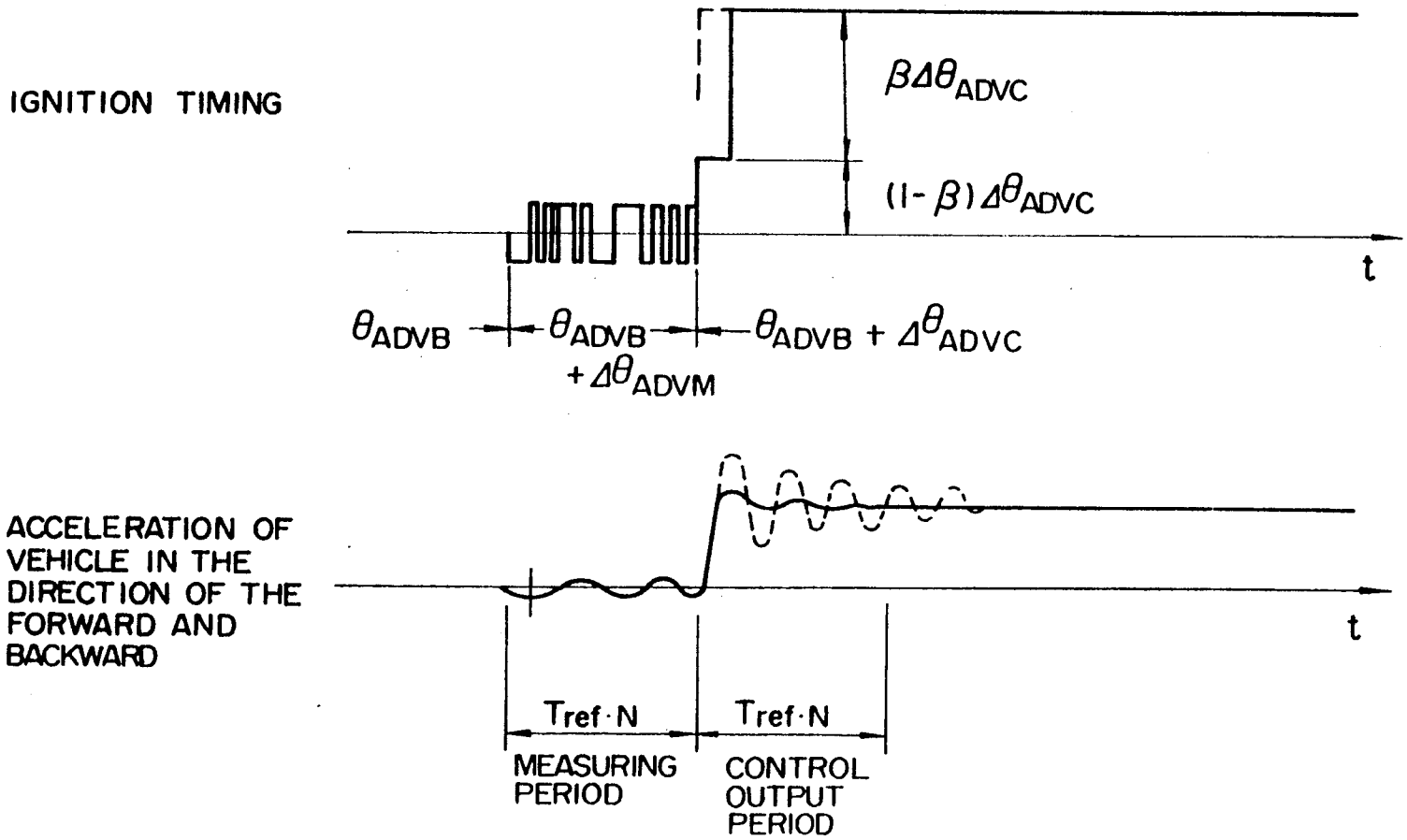
FIG. 9 is a diagram showing an example of a waveform which is prepared by superposing an ignition timing signal with the M series signal.

In other cases, the second control routine is restarted. Accordingly, the optimized signal component ignition advance angle $\Delta\theta$advC, for example, is produced in two stages as shown in FIG. 9, so that a sudden change in the ignition timing can be restricted.

Next, one example of the control timing chart of the optimized routine will be explained. FIG. 10 shows timings when each calculation routine is operated. FIG. 10A shows the case of optimizing an ignition timing and FIG. 10B shows the case of optimizing a fuel injection time.

A shown in (a) of FIG. 10A, the ignition timing setting routine is started with the timing of reference signals REF which are generated for each cylinder. Based on the result of this calculation, the ignition coil current is controlled and the ignition pulse is generated by setting the ignition timing in advance. Current conduction time of the ignition coil current is determined based on the output voltage of the battery, number of revolutions of the internal combustion engine, etc and a current conduction starting time Ts is adjusted to a value calculated by the ignition advance angle setting routine. For example, when the M series signal as shown in (c) of FIG. 10A has been given and the ignition advance angle has been changed by ±A, a current conduction starting time Tst is changed by ±A. As a result, an ignition timing Tf is adjusted as shown in (e) of FIG. 10A.

In the case of setting a fuel injection time. an M series signal of ±B as shown in (c) of FIG. 10B is inputted in synchronism with the REF signal, and a fuel injection time setting routine (d) is started so that a fuel injection time Ti is adjusted as shown in (e) of FIG. 10B.

The reference signals are generated at 110° before top dead center (TDC) of each cylinder. For a six cylinder engine, for example, reference signal REF are generated every 120°, that is, three pulses are generated per revolution, i.e. two revolutions are performed in one cycle so that six reference signals REF are generated during one cycle. In (a) of FIGS. 10A and FIG. 10B, reference signals $R_1$ to $R_3$ correspond to the first cylinder to the third cylinder only and the period $T_{ref}$ of the reference signal REF becomes smaller as the number of engine revolutions increases.

Independently of the ignition timing setting routine which is set to start synchronously with reference signal REF, an optimized control routine starts at an optimized control timing which is determined by dividing the reference signal REF into 1/m, where m is a predetermined integer. (g) and (h) of FIG. 10A show the case where m=5. As the timing period $T_{ref}/m$ at which the optimized control routine is set to start is proportional to the reference signal REF, the number of revolutions of the internal combustion engine is detected by measuring the interval of the optimized control timing operation. Since the detect number of revolutions has the same value within the period from one optimized control timing pulse generation to the next timing pulse generation (such as an interval T), the optimized control routine is set to start at anywhere within the interval T. Any number from 1 to 5 can be selected as the value for the integer m. However, even if a larger number of m is selected, the detected number of revolutions is virtually the same at low speed running and such a larger number will only result in increasing a burden on the microcomputer. In practice, a value such as 1 or 2 is adequate.

Figure 14:
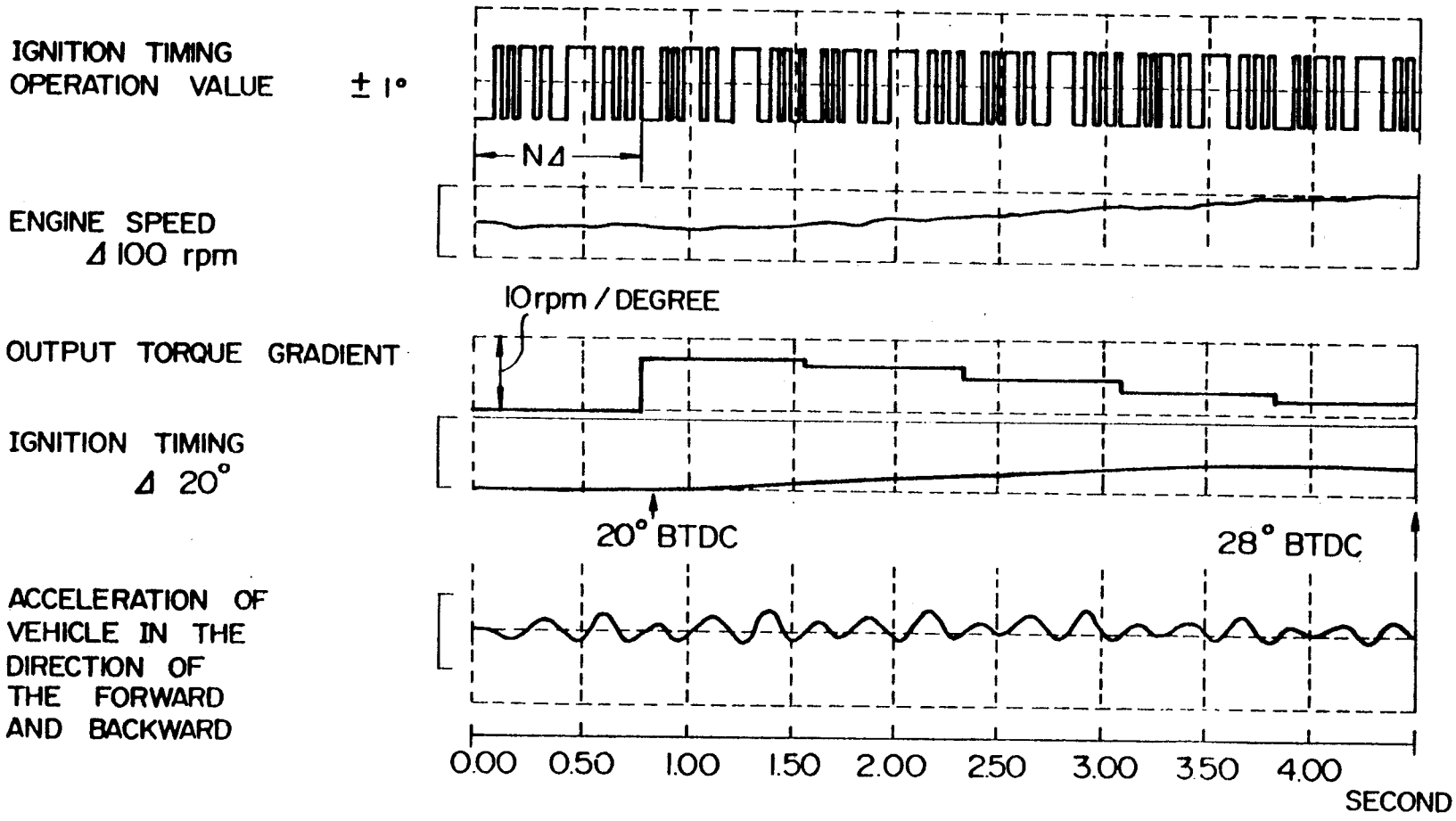
FIGS. 14, 15A(*a–c*), 15B(*a–c*) and 16(*a–d*) show the results of applying the system of the embodiment of the present invention to an actual car.

If the ignition advance angle setting routine and the optimized control routine are independently controlled as described above, both routines may not always be synchronized and, moreover, priority may be given with regard to either of the processings. As a result, the optimized control routine may be run on a time basis; further if there is insufficient processing time, the processing of the ignition advance angle setting routine may be given priority so that the control can be made certain. Additionally, as shown in FIG. 14, the processing may be separately executed during the measuring period for obtaining an output torque gradient in every period of the M series signal $T_{ref}\cdot N$ and during the control output period so as to control the ignition timing at an optimized value. Further, by separating the period for obtaining on output torque gradient from the period for operating an ignition timing, it is possible to avoid superposition of the change in the revolution number due to an ignition timing operation for an optimum control on the change in the revolution number by the M series signal. Therefore, an output torque gradient can be measured in high precision.

The minimum pulse width Δ of the M series signal is set at an integer as large as the number of combustion strokes of the internal combustion engine.

Figure 11A:
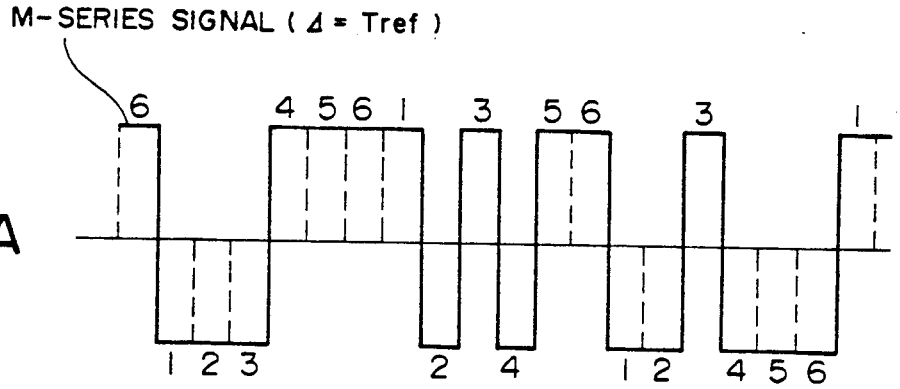
FIGS. 11A and 11B are diagrams showing examples of distribution of the M series signal to each cylinder.
Figure 11B:
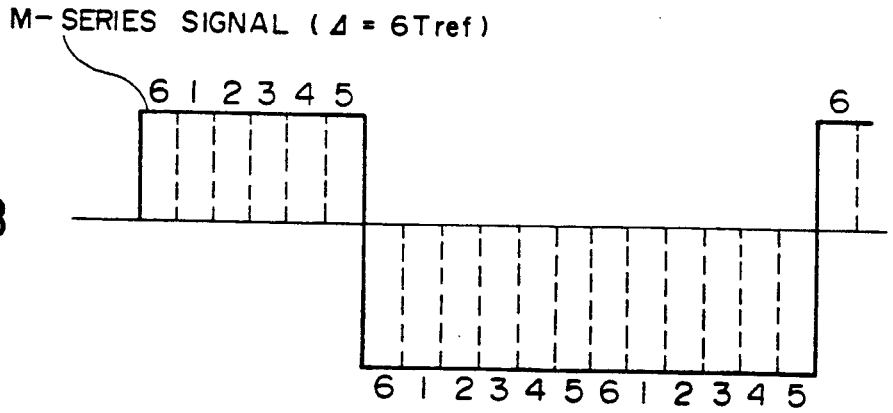

In the case of a six cylinder engine, for example, a reference signal REF is generated at every 120°, that is to say, six signals for every two revolutions, and the minimum pulse width Δ is set at an integer as large as the period $T_{ref}$ of the reference signal REF. For example, with an M series signal, if the minimum pulse width Δ as shown in (c) of FIGS. 10A and 10B is set at the same magnitude as the number of combustion strokes, then the result is as shown in FIG. 11A, and if the minimum pulse width is set to be six times as large as the number of combustion strokes then the result is as shown in FIG. 11B. If the minimum pulse width is set at the number of combustion strokes of the cylinders, all the cylinders are given the same ignition timing signal. If the minimum pulse width Δ is set as a magnitude less than the number of combustion strokes, it may happen that two or more ignition timing commands are given simultaneously to one cylinder or the M series signal falls into disorder. This minimum pulse width is set at a small magnitude with an increasing number of engine revolutions.

Next, another embodiment for performing optimized control using the M series signal will be explained.

Figure 12:
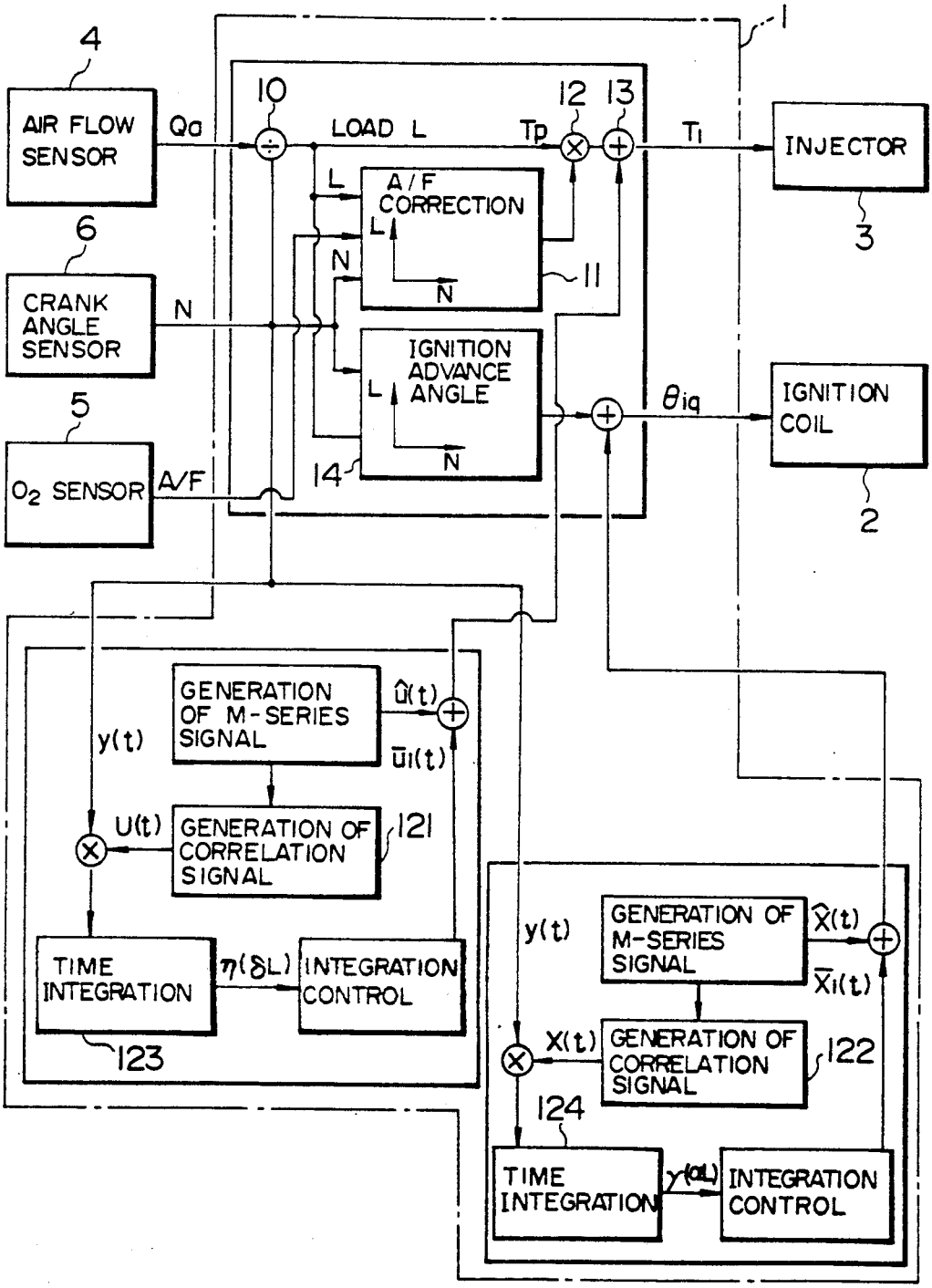
FIG. 12 is a block diagram showing another embodiment of the optimum control system according to the present invention.

FIG. 12 shows another embodiment of the optimum control system according to the present invention, which follows the sequential calculation method explained below.

In the calculations for the indicial response $\beta(\alpha L)$, the equation is transformed into a form of an equation (20) below by replacing the time integral in the mutual correlation function with the integral of the above phase α:

$$\begin{aligned}
\gamma(\alpha L) &\approx \int_{\alpha S}^{\alpha L}\left\{\phi\hat{x}y(\alpha) - \frac{1}{\alpha_2-\alpha_1}\int_{\alpha_2}^{\alpha_1}\phi\hat{x}y(\alpha)d\alpha\right\}d\alpha/Z \\
&= \frac{1}{N\Delta\cdot Z}\int_{\alpha S}^{\alpha L}\left\{\int_{o}^{N\Delta}\hat{x}(\hat{t}-\alpha)\cdot y(t)dt - \right. \\
&\quad \left.\frac{1}{\alpha_2-\alpha_1}\int_{\alpha_1}^{\alpha_2}\left\{\int_{o}^{N\Delta}\hat{x}(t-\hat{\alpha})\cdot y(t)dt\cdot d\alpha\right\}d\alpha\right. \\
&= \frac{1}{N\Delta\cdot Z}\int_{o}^{N\Delta}\left\{\int_{\alpha S}^{\alpha L}\hat{x}(t-\alpha)dt - \right. \\
&\quad \left.\frac{1}{\alpha_2-\alpha_1}\int_{\alpha S}^{\alpha L}\left\{\int_{\alpha_1}^{\alpha_2}\hat{x}(t-\alpha)\cdot d\alpha\cdot d\alpha\right\}y(t)dt\right. \\
&= \frac{1}{N\Delta\cdot Z}\int_{o}^{N\Delta}\left\{\int_{\alpha S}^{\alpha L}\hat{x}(t-\alpha)d\alpha - \right. \\
&\quad \left.\frac{\alpha_L-\alpha_S}{\alpha_2-\alpha_1}\int_{\alpha_1}^{\alpha_2}\hat{x}(t-\alpha)\cdot d\alpha\right\}y(t)dt \\
&= \int_{o}^{N\Delta}x(t)\cdot y(t)\cdot dt/(N\Delta\cdot Z)
\end{aligned} \tag{20}$$

where: x(t) is a function corresponding to the integration by parts of the $\hat{x}(t)$ represented by equation (21) below, and depends on $\hat{x}(t)$ only, with no relation to the response signal y(t) of a plant (internal combustion engine control system).

$$X(t) = \int_{\alpha S}^{\alpha L}\hat{x}(t-\alpha)d\alpha - \frac{\alpha L-\alpha S}{\alpha 2-\alpha 1}\int_{\alpha 1}^{\alpha 2}\hat{x}(t-\alpha)\cdot d\alpha \tag{21}$$

From equation (12):

$$\gamma(\alpha L) \approx \left\{\int_{o}^{N\Delta}x(t)\cdot\hat{y}(t)dt + \int_{o}^{N\Delta}x(t)\cdot\bar{y}(t)dt\right\}N\Delta\cdot Z \tag{22}$$

Reforming the above, the indicial response $\gamma(\alpha L)$ is represented by:

$$\gamma(\alpha L) = k_1\int_{o}^{N\Delta}x(t)\cdot y(t)dt \tag{23}$$

$$x(t) = \int_{\alpha S}^{\alpha L}\hat{x}(t-\alpha)d\alpha - k_2\int_{\alpha 1}^{\alpha 2}\hat{x}(t-\alpha)d\alpha \tag{24}$$

$$k_1 = \frac{2}{(N+1)\cdot\Delta\cdot a} \tag{25}$$

$$k_2 = \frac{\alpha L-\alpha S}{\alpha 2-\alpha 1} \tag{26}$$

x(t), which is given by equation (24), is the function which corresponds to the partially integrated value of the search signal x(t), and which is called a correlation signal. Not all the data of this correlation signal X(t) needs to be stored in a memory, provided the initial value X(o) is first determined and the difference is calculated at each timing. Now, when a sampling period is denoted by Ts, the following equations are used for the determination.

$$X(o) = \sum_{i=1}^{p}x(\Delta - iTs)\cdot Ts - k_2\sum_{i=1}^{p}x(\alpha_1 - iTs)\cdot Ts \tag{27}$$

$$\begin{aligned}
X(t) - x(t-Ts) = Ts\,[&\hat{x}(Ts+\Delta) - \\
&x(t+\Delta-(p+1)Ts) - k_2\{x(t-\alpha_1) - \\
&x(t-\alpha_1-(q+1)Ts)\}]
\end{aligned} \tag{28}$$

$$\text{provided } p = \frac{\alpha L-\alpha S}{Ts},\ q\ \frac{\alpha_2-\alpha_1}{Ts} \tag{29}$$

If the time interval in the equation (28) is approximated by a moving average, the data storage capacity required for the integral calculation will be greatly reduced.

FIG. 18 shows a diagram of the system which is structured based on the equation (20). According to the present embodiment, correlation signals U(t) 121 and X(t) 122 which are calculated in advance in synchronism with the M series signal in accordance with the equation (28) and stored, are sequentially generated. These signals are multiplied by an output revolution number y of the internal combustion engine, results of which are time integrated with the cycle of the M series signal as shown in 123 and 124, to obtain output torque gradients $\eta(\delta L)$ and $\gamma(\alpha L)$.

Figure 13A:
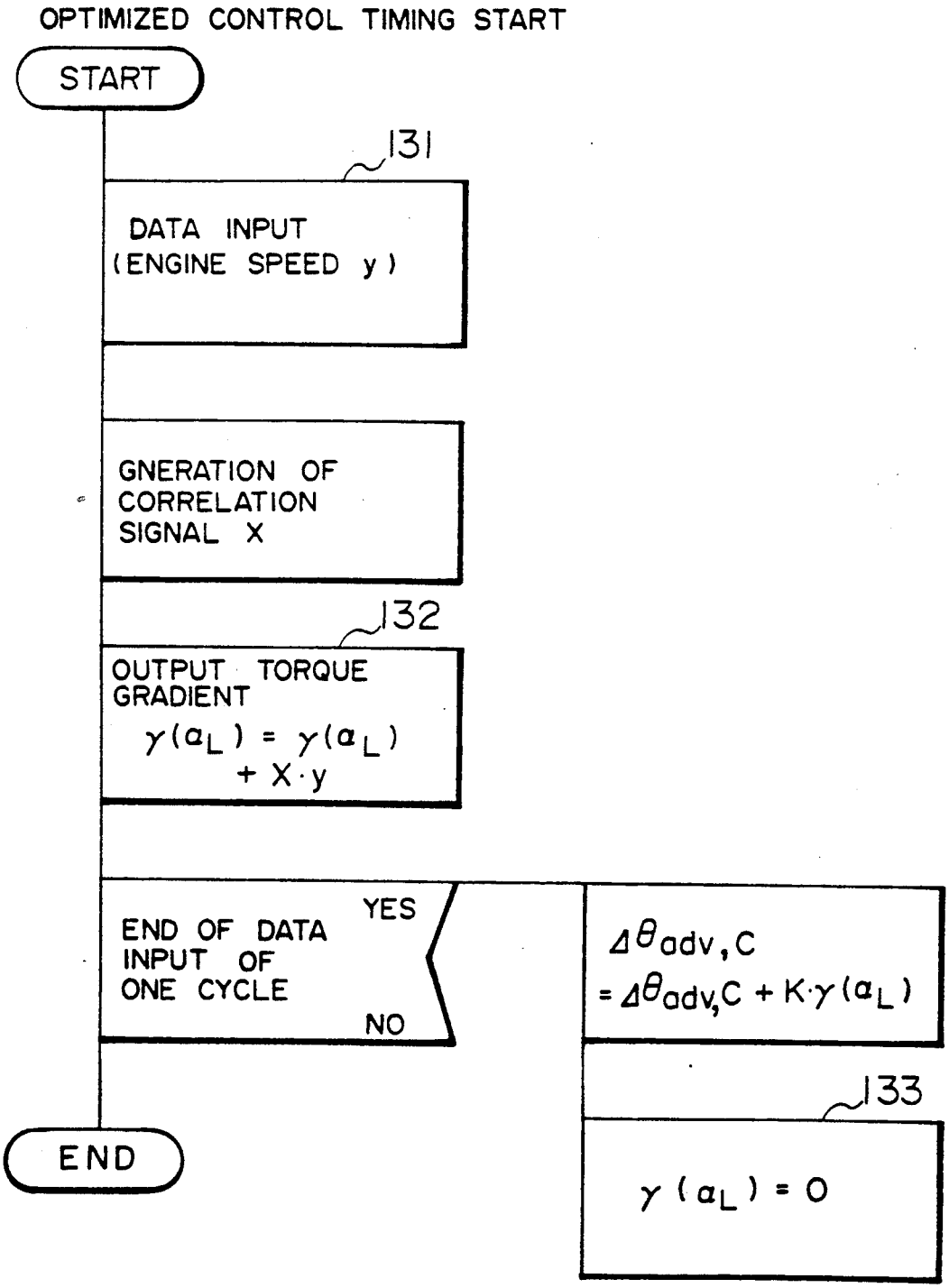
FIGS. 13A and 13B are flow charts applied when the system of FIG. 12 is implemented by using a microcomputer.
Figure 13B:
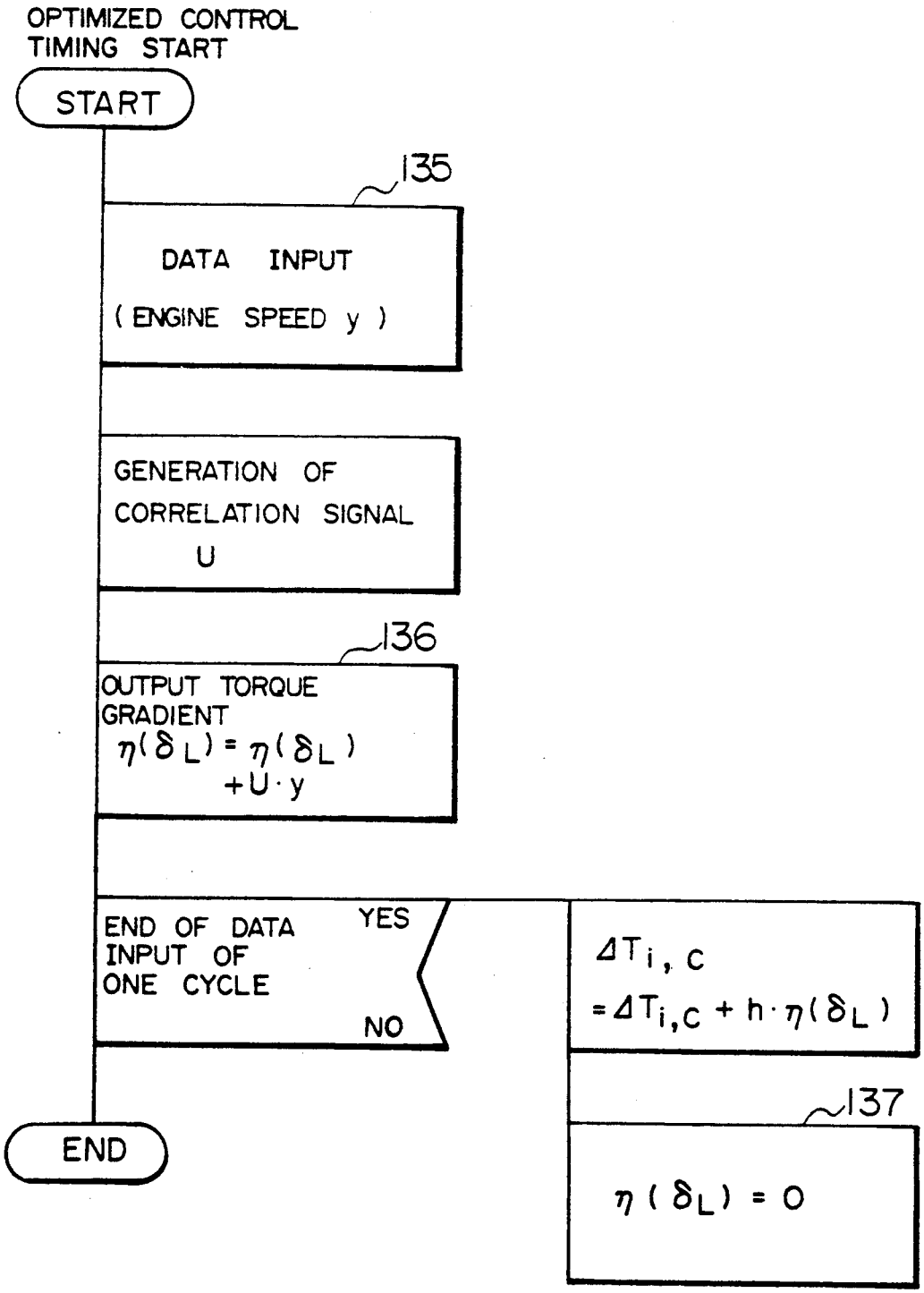

FIGS. 13A and 13B show flow charts of optimized control programs for the ignition timing and the fuel injection time respectively when the optimum control system in FIG. 12 is executed by using a microcomputer. The revolution number y of the internal combustion engine is sampled by data input 131 or 135, and correlation signals X and U are generated in synchronism with the generation of the M series signal. Then, in accordance with an equation (30), the output torque gradient $\gamma(\alpha L)$ or $\eta(\delta L)$ is calculated at steps 132 and 136.

$$\gamma(\alpha L)=\gamma(\alpha L)+X\cdot y \quad (30)$$

$$\eta(\delta L)=\eta(\delta L)+U\cdot y \quad (31)$$

In the case of performing the above processing by only one cycle of the M series signal (or the correlation signal), the optimized signal component advance angle $\Delta\theta$advC or $\Delta$TiC is obtained in accordance with the equations (18) and (19). Then, the output torque gradient $\gamma(\alpha L)$ or $\eta(\delta L)$ is reset to prepare for the calculation of the next cycle.

Since the correlation function is calculated sequentially in the present embodiment, it is not necessary to store the M series signal x(t) and revolution number y of the internal combustion engine over one cycle of the M series signal, so that the memory capacity can be reduced substantially. Further, since integration based on the phase $\alpha$ is performed in advance, only time integration is necessary in real time, so that operation time can be reduced substantially, as well.

FIG. 14 shows a result of a simulation of the case where the optimum control system according to the present embodiment is applied to a six-cylinder internal combustion engine. In accordance with the M series signal, plus or minus 1° of operation input is superposed on an ignition timing by cylinder. A mutual correlation function between the detected number of revolutions of the engine was calculated for each period of the M series signal to provide an output torque gradient. As a result of sequentially superposing the integrated value of the output torque gradient obtained on the ignition timing signal, the ignition timing moved from its initial position of 20° before TDC to a new position of 28° before TDC (the optimum position) in about 4 seconds. At this moment, the acceleration of the vehicle in the direction of travel was within ±0.03G, which is in a range that would not be perceived by a driver.

Figure 15A:
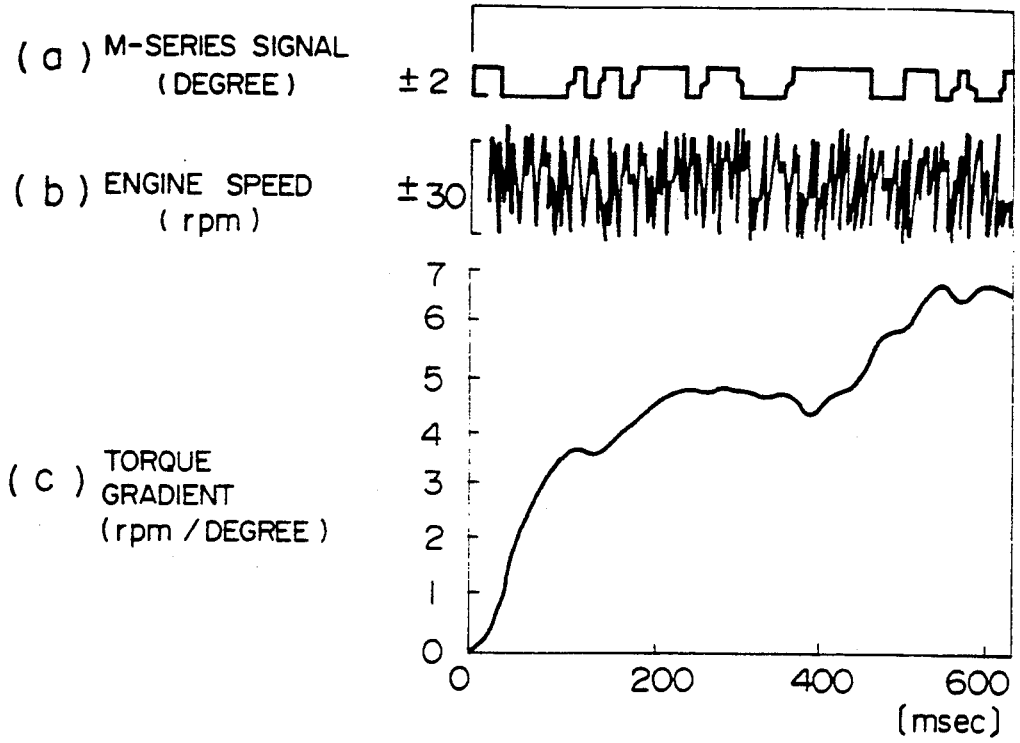

FIG. 15*a* shows an example of the case where the M series signal is continuously superposed on the ignition signal to obtain the torque gradient $\gamma(\alpha L)$ based on a test using an actual car. If the M series signal is given a change of ±2° as shown in (a) of FIG. 15A, then the number of revolutions of the crank shaft changes by approximately ±30 rpm as shown in (b) of FIG. 15A. When the M series signal is superposed for approximately 600 msec, the torque gradient $\gamma(\alpha L)$ changes by about 6.5 rpm/degree. As explained in the embodiment of FIG. 2, the torque gradient is determined in such a way that the mutual correlation function between the M series signal $\hat{x}(t)$ and the output y(t) is calculated using the equation (13'), and then by using this mutual correlation function, the torque gradient was determined with the equations (14) and (15).

Figure 15B:
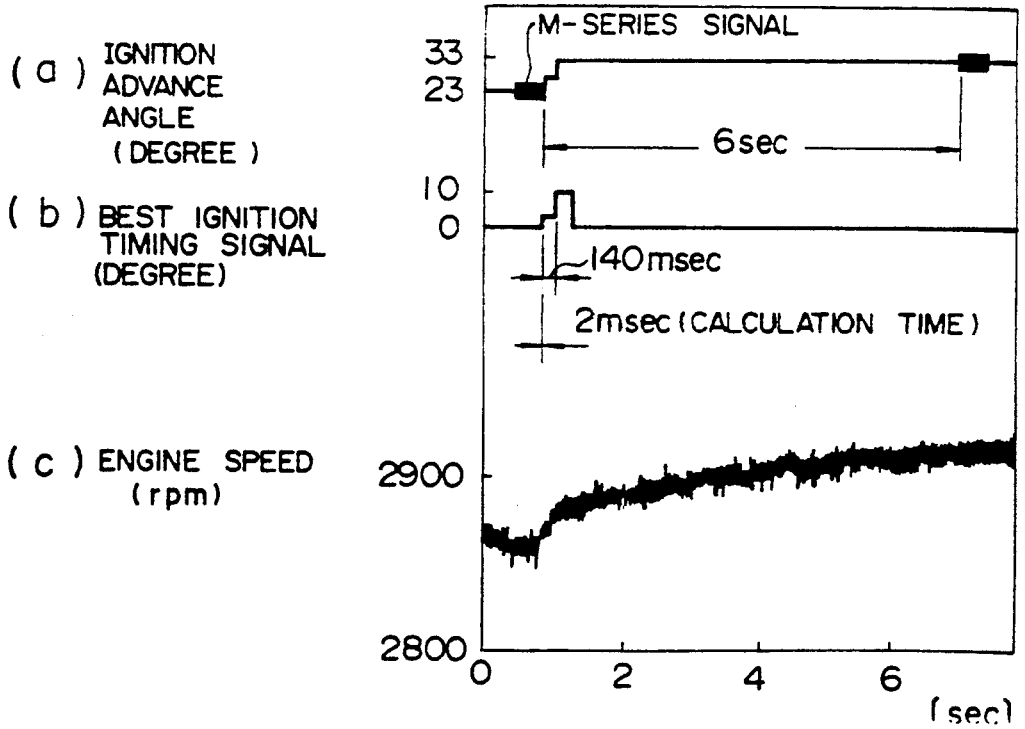

FIG. 15B shows results of a test carried out in a similar manner by using an actual car, where the M series signal was superposed for 620 msec. to measure a torque gradient. As a result, the ignition timing was corrected by about 10°. After a control cycle of 6 sec. the M series signal was applied again to measure similarly. However, since the ignition timing was near the optimum value, the torque gradient value was small so that the ignition timing was not corrected. In other words, the revolution speed exhibited a hill climbing characteristic as shown in (c) of FIG. 15B and the ignition timing moved to the optimum position.

As described above, according to the present invention, it is possible to control the ignition timing of an engine control system even if there is small change in the engine revolution speed of a car.

Figure 16:
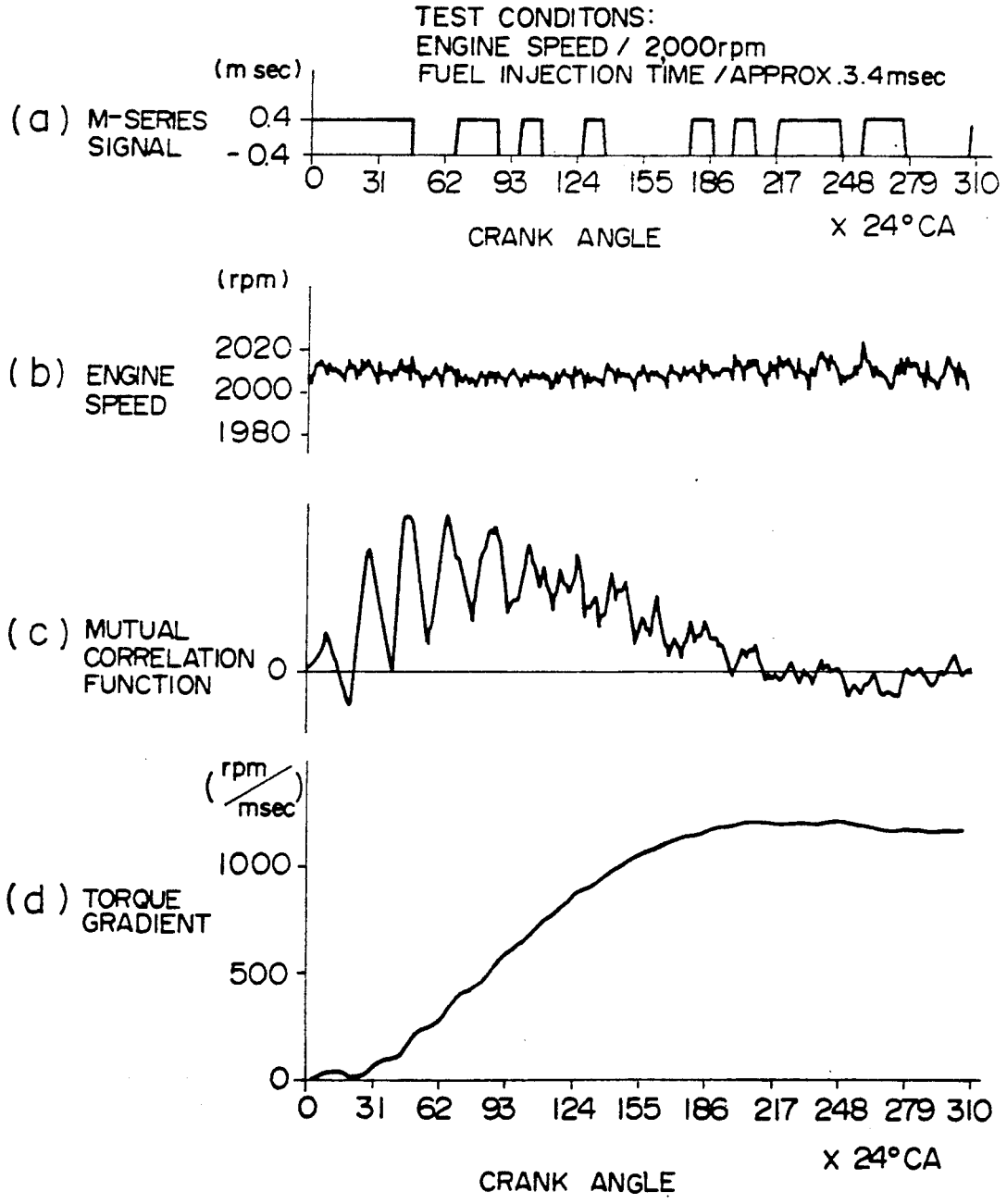

FIG. 16 shows an example of the case where, in the optimum control system of the embodiment of the present invention, the M series signal is continuously superposed on the fuel injection time to measure a torque gradient $\eta(\alpha L)$ by a test using an actual car. According to this experiment, the M series signal which is inputted at every 24° of crank angle and the engine revolution number are measured. Experiment conditions are N=31, $\Delta 2T_{ref}$ and m=5 in FIG. 10B. When the engine revolution number was 2000 rpm constant, the fuel injection time was about 4 msec. Based on the M series signal that has been successively applied, the engine revolution number (b) changes. the M series signal is added to the fuel injection time in plus or minus 0.4 msec. In this case, the mutual correlation function between the M series signal and the engine revolution number was obtained as shown in (c), which was then integrated to obtain 1200 rpm/msec. as a torque gradient. This indicates that the engine revolution number increases by 1200 rpm when the fuel injection time is extended by 1 msec.

it is natural that the engine revolution number increases when the fuel quantity is increased in the normal driving. However, in the situation other than the normal driving, such as an engine starting period or an engine warm-up period immediately after that, it is general that the choke is throttled and a fuel-air mixture gas has a very high fuel concentration. In this case, the control system does not have adaptability to determine a fuel injection time in accordance with a predetermined value, so that there occur various abnormal combustion such as smoking of ignition plugs, etc. If the present invention is applied in such a situation as described above, it becomes possible to determine a fuel injection time which is necessary enough to obtain an engine revolution number that is required for starting the engine operation for warm-up, thereby eliminating factors which aggravate the combustion state such as smoking of the ignition plugs.

Figure 17:
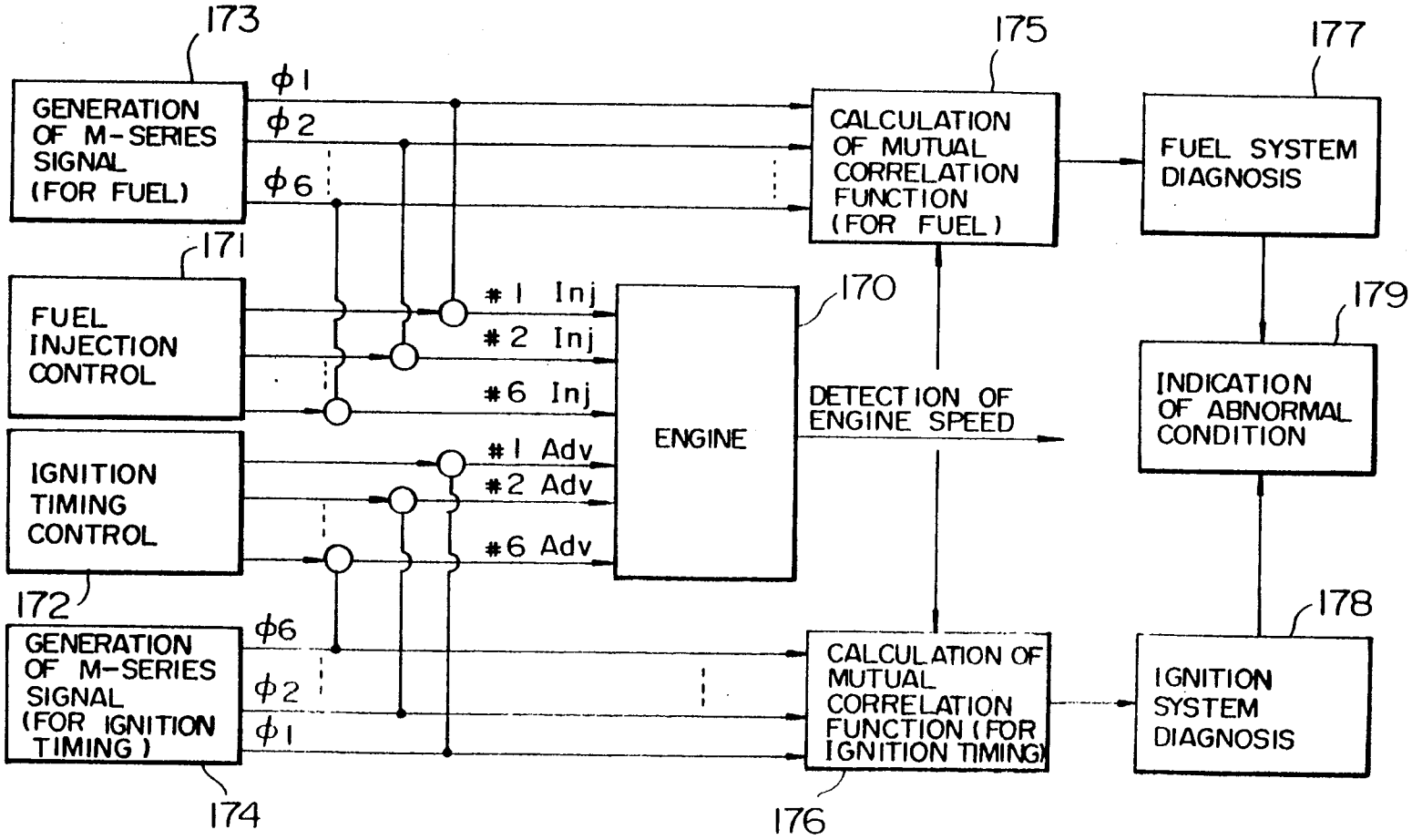
FIG. 17 is a block diagram showing still another embodiment of the optimum control system according to the present invention.

FIG. 17 shows a structure of an embodiment for inputting the M series signal at the fuel injection time and the ignition timing by cylinders in a six-cylinder engine. The control system of an engine 170 basically comprises a fuel injection time control 171 and an ignition timing control 172, each having individual M series signal generators 173 and 174 respectively. The M series signal is inputted to each independent cylinder, and is superposed on the fuel injection time #1 Inj of a first cylinder to #6 Inj of a sixth cylinder and the ignition timing #1 Adv of the first cylinder to #6 Adv of the sixth cylinder. Mutual correlation functions between these input signals and the engine revolution numbers are also calculated by cylinders for each of the fuel injection time and ignition timing as shown in 175 and 176.

Figure 18A:
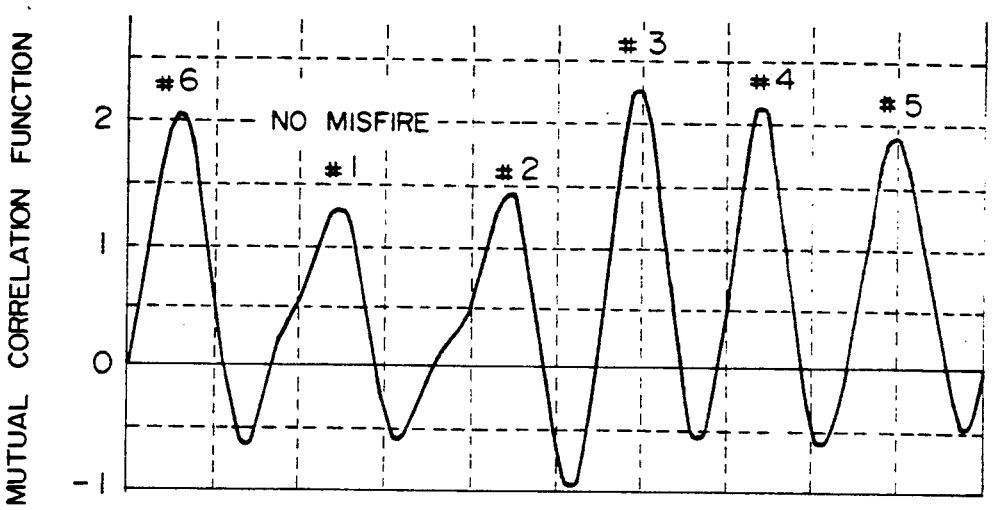
FIGS. 18A and 18B are explanatory waveform diagrams in the case of detecting a misfire in an internal combustion engine by utilizing the present invention.
Figure 18B:
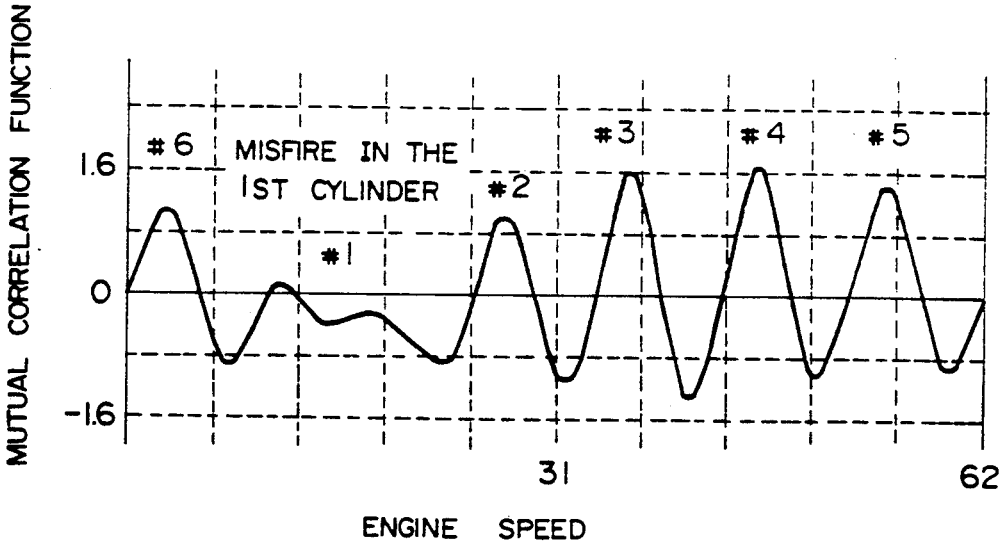

With the structure as shown in FIG. 17, it is possible to detect abnormal combustion and torque reduction attributable to deterioration or fault of an injector, an ignition coil, an ignition power transistor, an ignition plug, etc. of a specific cylinder. FIGS. 18A and 18B show results of a simulation of an example of the case where a misfire is detected by using the present invention. In the normal combustion, a mutual correlation function as shown in FIG. 18A is obtained, whereas an extreme difference appears in the mutual correlation function when a misfire occurs in the first cylinder as shown in FIG. 18B. Thus, a misfire can be detected.

A fault diagnosis method for the ignition system and the fuel system according to the present invention will be explained next. In the present diagnosis method, an example is shown for implementing fault diagnosis by cylinders in the case the structure of FIG. 17 is applied. It is also possible to use the structure shown in FIG. 2 or FIG. 12. A diagnosis portion 177 of the fuel system judges whether the fuel system is normal or not based on a mutual correlation function relating to the fuel flow quantity. If the fuel system is abnormal, a display portion 179 generates an abnormal alarm signal. In the mean time, a diagnosis portion 178 of the ignition system judges whether the ignition system is normal or not based on a mutual correlation function relating to the ignition timing. If the ignition system is abnormal, a display portion 179 generates an abnormal alarm signal. The diagnosis portions 177 and 178 can be realized by using a micro computer.

Figure 19:
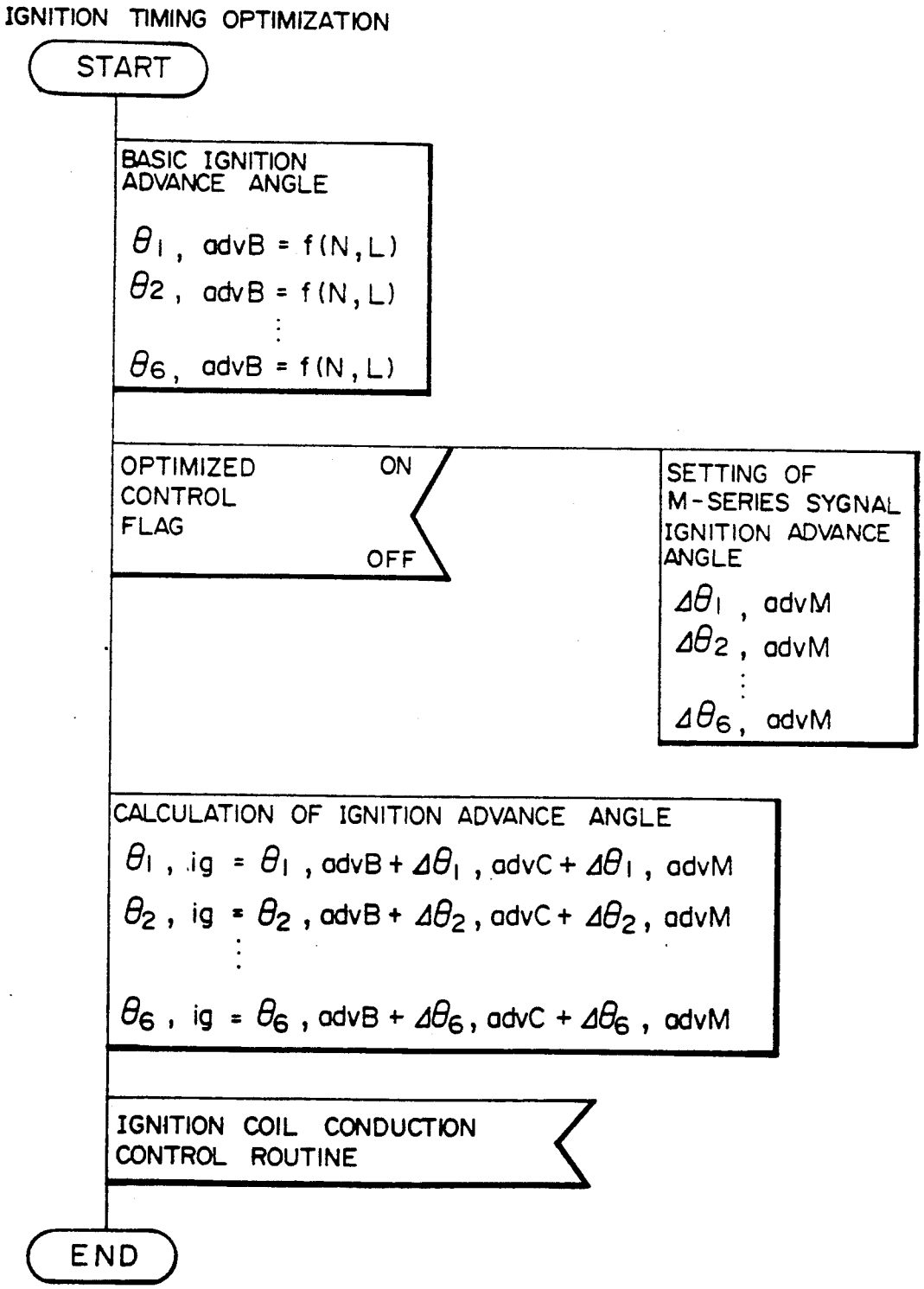
FIG. 19 is a flow chart for determining an optimum ignition timing according to the embodiment of the present invention.

FIG. 19 shows a processing routine for determining an optimum ignition timing by cylinders from each of correlation functions by independently inputting the M series signal by cylinders in the structure shown in FIG. 17. Contents of the basic processings are based on those in FIG. 4A. Further, contents of the basic processings of the processing routine for determining an optimum fuel injection quantity in the fault diagnosis method, not shown, are based on FIG. 4B. In the manner similar to the structure in FIG. 19, this processing routine has a fuel injection time Ti, a basic fuel injection time TiB, an M series signal component fuel injection time ΔTiM, and an optimized signal component fuel injection time ΔTiC, by cylinders.

Figure 20A:
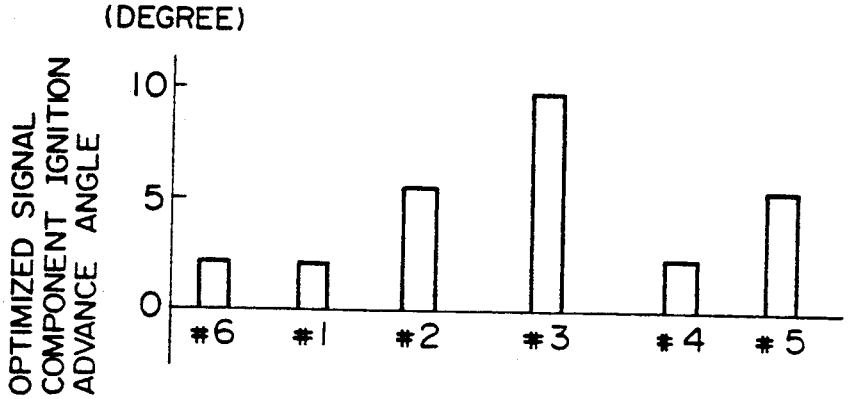
FIGS. 20A, 20B and 20C are diagrams for explaining the method of diagnosing an abnormal condition of an ignition system by giving an optimum ignition timing.
Figure 20B:
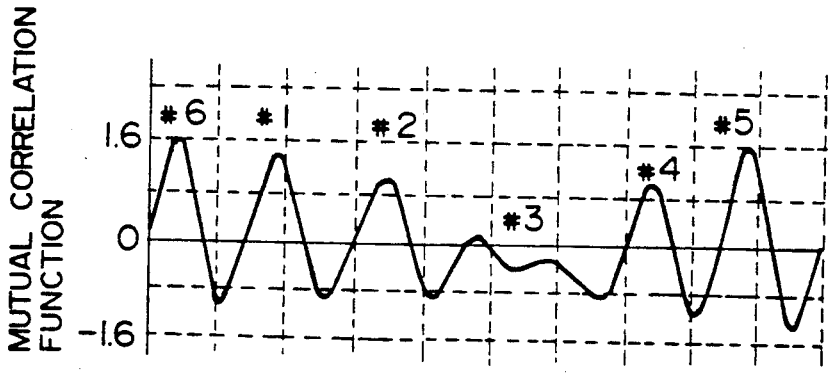
Figure 20C:
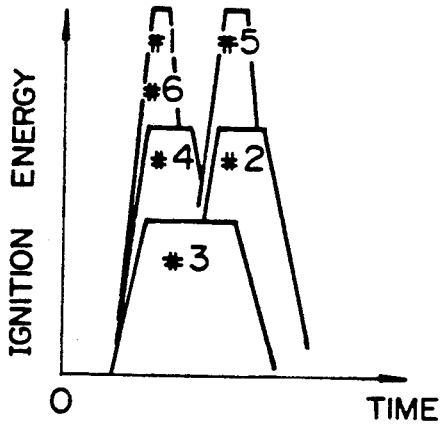

FIG. 20A shows a state that the optimized signal component ignition advance angle $\Delta\theta$advC in the equation (16) obtained by the processing in FIG. 19 is different by cylinders. There is an abnormal indication that the ignition advance angle must be further advanced by 5 to 10 degrees from the basic ignition advance angle as shown for the cylinder numbers 2, 3 and 5. FIG. 20B shows mutual correlation functions, in which the cylinder number 3 has an abnormal correlation and the cylinder numbers 2 and 4 have low correlation. FIG. 20C shows these phenomena in time transition of ignition energy. It is considered that the cylinder numbers 1 and 6 have satisfactory characteristics, but the cylinder number 5 has a delay in the discharge timing. Further, the cylinder numbers 2 and 4 have a slight reduction in the ignition power, and the cylinder number 3 has a large reduction in the ignition power.

Figure 21:
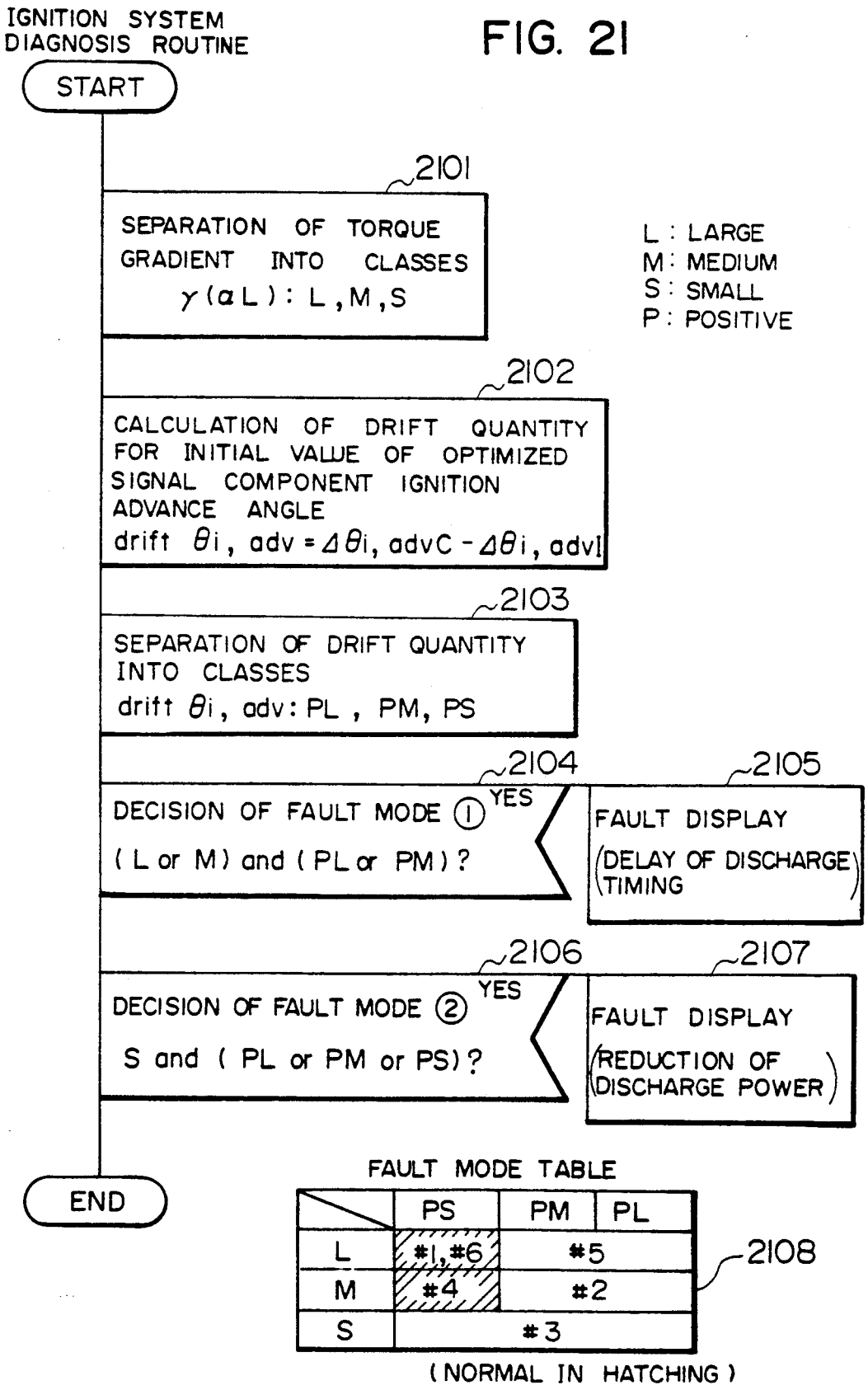
FIG. 21 is a flow chart of diagnosis of an abnormal condition of an ignition system.

An example of the processing flow of the above diagnosis process will be explained below with reference to FIG. 21. This flow chart shows the steps for judging delay of discharging timing, reduction of discharging power, etc. based on an optimized signal component ignition advance angle obtained by cylinders and torque gradient calculated at the same time. In this case, degree of a fault is qualitatively, not quantitatively, expressed by using a hierarchical separation method of the fuzzy logic.

The processing flow in the diagnosis portion 178 will be explained below with reference to FIG. 21. First, the torque gradient $\gamma(\alpha L)$ is separated into three classes of Large, Medium and Small. When the time characteristics of the ignition energy (which can be expressed by the secondary current of the ignition coil) rise suddenly like in the cylinder numbers 1, 6 and 5 in FIG. 20C, even a slight variation of the ignition timing strongly affects the combustion so that the mutual correlation function becomes a large value. Thus, an increase in the torque gradient is utilized. Therefore, there is no sharp peak in the ignition energy such as in the cylinder number 3 of FIG. 20 of which torque gradient is small. Next, a drift quantity $\theta$i, adv for the initial value of an optimized signal component ignition advance angle is calculated (2102). The initial value $\Delta\theta$i, adv is determined in advance, for example, at the time of shipment. The initial value may be different by cylinders because of characteristics on the structure of the engine. Next, the drift quantity is separated into three classes of Positive Large (PL), Positive Medium (PM) and Positive Small (PS) (2103). A fact that a drift quantity is large for the initial value of an optimized signal component ignition advance angle means that time deterioration has occurred in the ignition system. Therefore, it is an object to qualitatively evaluate the degree of time deterioration by the separated classes. This diagram shows the case where delay of discharge timing and reduction of discharge power are employed as decision items for deciding a fault mode of an ignition system. In the former case, delay in discharging timing is decided (2104) and displayed (2105) when the torque gradient is L or M and the drift quantity is PL or PM. In the latter case, reduction of discharge power is decided (2106) and displayed (2107) when the torque gradient is S and the drift quantity is PL or PM or PS. A fault mode table (2108) added to this diagram shows how an example of time characteristics of ignition energy shown in FIG. 2C is hierarchically separated.

Abnormal conditions may be displayed individually by causes of abnormal conditions, that is, an abnormal situation due to reduction of discharge power and an abnormal situation due to delay in discharge timing. Alternately, abnormal conditions may be informed by generating a common alarm of abnormality when there is one of the two different types of abnormality occurs.

Figure 22A:
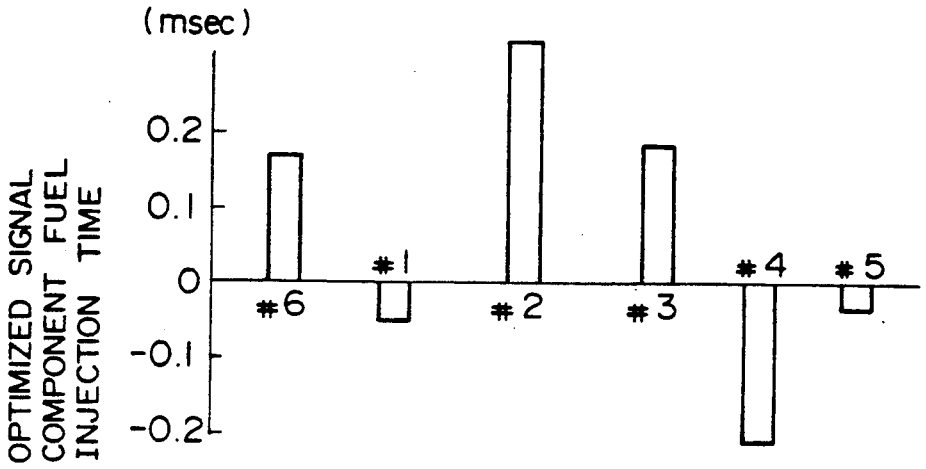
FIGS. 22A, 22B and 22C are diagrams for explaining the method of diagnosing an abnormal condition of a fuel system by giving an optimum fuel injection quantity.
Figure 22B:
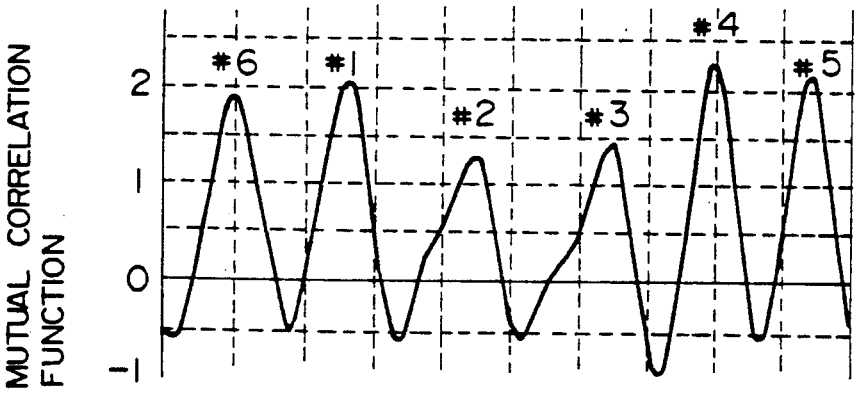
Figure 22C:
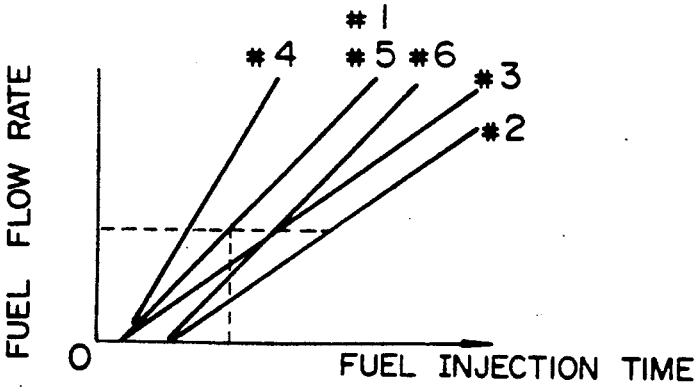

FIG. 22*a* shows a state that an optimized signal component fuel injection time ΔTiC in the equation (16') obtained by the processing in FIG. 19 is different by cylinders. There is an abnormal condition in the cylinder numbers 2, 3 and 6 in which a fuel must be injected for a longer time than the basic fuel injection time, by 0.1 to 0.3 msec. FIG. 22B shows a mutual correlation function which indicates that the correlations in the cylinder numbers 2 and 3 are abnormally low. FIG. 22C shows these phenomena in fuel injection quantities which change with time. From this diagram, it is considered that, as compared with satisfactory characteristics of the cylinder numbers 1 and 5, the cylinder number 6 has a long invalid time of fuel injection and that fuel injection efficiency dropped in the cylinder numbers 2 and 3. Conversely, the cylinder number 4 has an excessive efficiency of fuel injection.

Figure 23:
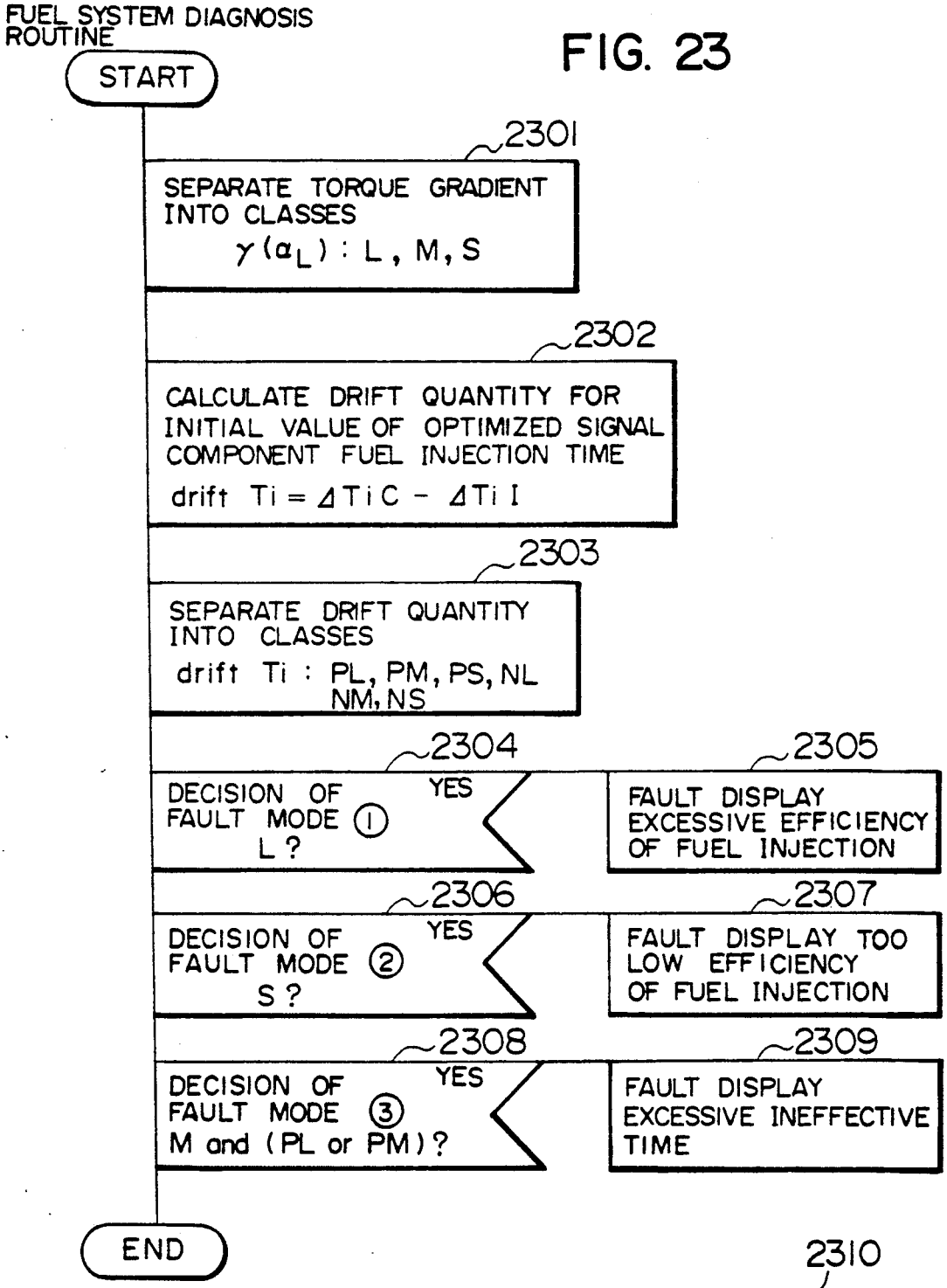
FIG. 23 is a flow chart of diagnosis of an abnormal condition of a fuel system.

An example of the processing flow of the above diagnosis process will be explained below with reference to FIG. 23. FIG. 23 shows a process for judging a too high or too low efficiency of fuel injection or an excessive invalid time based on an optimized signal component fuel injection time obtained by cylinders and torque gradient calculated at the same time.

The processing flow will be explained below with reference to FIG. 23. First, the torque gradient $\gamma(\alpha L)$ is separated into three classes of Large, Medium and Small (2301). When the time characteristics of fuel injection quantity are standard, such as seen in the cylinder numbers 1, 5 and 6 in FIG. 22C, the torque gradient also takes a medium value. When the fuel injection efficiency is too high, such as seen in the cylinder number 4, even a slight variation in the fuel injection time strongly affects the combustion so that a mutual correlation function takes a large value and the torque gradient increases accordingly. Conversely, the torque gradient increases in the cylinder numbers 2 and 3. Next, a drift quantity Ti for the initial value of an optimized signal component fuel injection time is calculated (2302). The initial value ΔTil is stored in advance, for example, at the time of shipment. The initial value may be different by cylinders because of the characteristics of the structure of the engine. Next, the drift quantity is separated into three classes of PL, PM and PS or Negative Large (NL), Negative Medium (NM) and Negative Small (NS) (2303). A large drift quantity for the initial value of an optimized signal component fuel injection time means an occurrence of time deterioration of a fuel system. It is an object to qualitatively evaluate the degree of time deterioration by separating the torque gradient into the classes. This diagram shows a case where a too high or too low efficiency of fuel injection or an excessive invalid time is taken up as a decision item of a fault mode of a fuel system. In the former case, when the torque gradient is L, the fuel injection efficiency is decided to be too high (2304) and this is displayed (2305). When the torque gradient is S, the fuel injection efficiency is decided to be too low (2306) and this is displayed (2307). In the latter case, when the torque gradient is M and the drift quantity is PL or PM, the invalid time is decided to be excessive (2308) and this is displayed (2309). A fault mode table (2310) added to FIG. 23 shows how an example of time characteristics of a fuel injection quantity shown in FIG. 22C is hierarchically separated.

The method of displaying abnormal conditions is the same as the one for the above-described diagnosis of an ignition system.

It should be noted that the above-described abnormal combustions and abnormal conditions of an ignition system can also be detected based on outputs from a cylinder pressure sensor, an $O_2$ sensor and an vibration sensor and by obtaining an M series signal and a mutual correlation function, though no examples thereof are shown here, in addition to the number of engine revolutions as utilized in the above-described embodiments.

We claim:

1. A method for controlling a fuel flow quantity of an internal combustion engine having a control system for calculating a fuel flow quantity signal and an ignition timing signal to be supplied to the internal combustion engine in accordance with a revolution number and load of the internal combustion engine, comprising the steps of:

superposing a search signal for fine adjusting a fuel flow quantity value on said fuel flow quantity signal;

applying the fuel quantity signal superposed with said search signal to a fuel supply apparatus of said internal combustion engine;

detecting a value of a parameter showing a revolution number or an operation state of said internal combustion engine in response to said superposed signal;

detecting a correlation between said detected value and said search signal; and correcting said fuel flow quantity signal based on said detected correlation;

wherein said search signal is a random signal of which auto correlation function is substantially an impulse shape, said step of detecting a correlation includes a step of calculating a mutual correlation function between said detected value and said search signal, and said step of correction is an addition of a corrected value to said fuel flow quantity signal based on said calculated mutual correlation function.

2. A method for controlling a fuel flow quantity of an internal combustion engine according to claim 1, wherein said search signal is a signal of which auto correlation function is substantially expressed by a delta function, said step of detecting a correlation includes a step of calculating a mutual correlation function between said detected value and said search signals and said step of correcting is an addition of a corrected value to said fuel flow quantity signal based on said calculated mutual correlation function.

3. A method for controlling a fuel flow quantity of an internal combustion engine according to claim 1, wherein said search signal is a signal of which auto correlation function is a pseudo random series, said step of detecting a correlation includes a step of calculating a mutual correlation function between said detected value and said search signal, and said step of correcting is an addition of a corrected value to said fuel flow quantity signal based on said calculated mutual correlation function.

4. A method for controlling a fuel flow quantity of an internal combustion engine according to claim 3, wherein said pseudo random series is an M series.

5. A method for controlling a fuel flow quantity of an internal combustion engine according to claim 4, wherein said search signal of the M series has two different values, and the minimum pulse width thereof is an integer times the combustion process period of said internal combustion engine.

6. A method for controlling a fuel flow quantity of an internal combustion engine according to any one of claims 1 and 2 to 5, wherein said step of correction further includes the steps of calculating an impulse response of said control system by using said mutual correlation function, calculating an indicial response by integrating said impulse response, and using a signal obtained from said indicial response as said corrected value.

7. A method for controlling a fuel flow quantity of an internal combustion engine according to claim 1, wherein said control system carries out an air-fuel ratio feedback control by using an oxygen density sensor for detecting a density of oxygen in an exhaust gas, and said step for detecting a parameter for showing an operation state is a detection of an output from said oxygen density sensor as said parameter.

8. A method for controlling a fuel flow quantity of an internal combustion engine according to claim 1, wherein said step of detecting a correlation includes a step of storing a correlation signal obtained by partially integrating said search signal, a step of reading said stored correlation signal in synchronism with said search signal and a step of multiplying said read correlation signal with said detected value and then time integrating said multiplied value, and said step of correcting is an addition of a corrected value based on the result of said time integration to said fuel flow quantity signal.

9. A method for controlling a fuel flow quantity of an internal combustion engine according to claim 8 wherein said step of time integrating includes the steps of time integrating said multiplied value with a cycle of said search signal and calculating an output torque gradient of the internal combustion engine for said search signal, and said step of correcting is a determination of said corrected value based on said output torque gradient.

10. A fuel flow quantity control apparatus for an internal combustion engine having a control system for calculating a fuel flow quantity signal and an ignition timing signal to be supplied to an internal combustion engine in accordance with a revolution number and load of the internal combustion engine, comprising:

means for detecting a revolution number of an internal combustion engine;

means for detecting a quantity of air taken in by said internal combustion engine;

means for determining a fuel flow quantity of a fuel to be supplied to said internal combustion engine;

means for supplying a fuel to said internal combustion engine based on said determined fuel flow quantity value;

means for generating a search signal for fine adjusting a fuel flow quantity;

means for generating a signal which is said search signal superposed on said fuel flow quantity value and then supplying said superposed signal to said fuel flow quantity value determination means;

means for detecting a correlation between the revolution number of said internal combustion engine and said search signal in response to said superposed signal; and means for correcting said fuel flow quantity signal base on said detected correlation;

wherein said means for generating a search signal generates a random signal of which auto correlation function is substantially an impulse shape, said means for detecting a correlation includes means for calculating a mutual correlation function between said revolution number and said search signal, and said means for correcting includes means for determining a corrected value to be added to said fuel flow quantity signal based on said calculated mutual correlation function.

11. A fuel flow quantity control apparatus for an internal combustion engine according to claim 10, wherein said search signal generation means generates a signal of which auto correlation function is substantially expressed by a delta function, said means for detecting a correlation includes means for calculating a mutual correlation function between said revolution number and said search signal, and said means for correcting includes means for determining a corrected value to be added to said fuel flow quantity signal based on said calculated mutual correlation function.

12. A fuel flow quantity control apparatus for an internal combustion engine according to claim 10, wherein said search signal generation means includes means for generating a signal of which auto correlation function is a pseudo random series, said means for detecting a correlation includes means for calculating a mutual correlation function between said revolution number and said search signal, and said means for determining a corrected value determines said corrected value based on said calculated mutual correlation function.

13. A fuel flow quantity control apparatus for an internal combustion engine according to claim 12, wherein said pseudo random series is an M series.

14. A fuel flow quantity control apparatus for an internal combustion engine according to claim 13, wherein said search signal of the M series has two different values, and the minimum pulse width thereof is an integer times the combustion process period of said internal combustion engine.

15. A fuel flow quantity control apparatus for an internal combustion engine according to any one of claims 11 to 14, wherein said means for correcting further includes means for calculating an impulse response of said control system and means for calculating an indicial response by integrating said impulse response, and a signal obtained from said indicial response is used as said corrected value.

16. A fuel flow quantity control apparatus for an internal combustion engine according to claim 10, wherein said means for detecting a correlation includes means for storing a correlation signal obtained by partially integrating said search signal, means for reading said stored correlation signal in synchronism with said search signal and means for multiplying said read correlation signal by said detected value and then time integrating said multiplied value, and said means for correcting includes means for determining a corrected value to be added to said fuel flow quantity signal based on the result of said time integration.

17. A fuel flow quantity control apparatus for an internal combustion engine according to claim 16, wherein said means for time integration time integrates said multiplied value with a cycle of said search signal, and said means for calculating an output torque gradient of an internal combustion engine for said search signal and said means for correcting determine said corrected value based on said output torque gradient.

* * * * *